US010940478B2

(12) United States Patent
Holmes et al.

(10) Patent No.: US 10,940,478 B2
(45) Date of Patent: Mar. 9, 2021

(54) CONTACT-LINE-DRIVEN MICROFLUIDIC DEVICES AND METHODS

(71) Applicant: University of Washington, Seattle, WA (US)

(72) Inventors: Hallie R. Holmes, Seattle, WA (US); Karl F. Bohringer, Seattle, WA (US)

(73) Assignee: University of Washington, Seattle, WA (US)

( * ) Notice: Subject to any disclaimer, the term of this patent is extended or adjusted under 35 U.S.C. 154(b) by 298 days.

(21) Appl. No.: 16/071,869

(22) PCT Filed: Jan. 23, 2017

(86) PCT No.: PCT/US2017/014529
§ 371 (c)(1),
(2) Date: Jul. 20, 2018

(87) PCT Pub. No.: WO2017/127792
PCT Pub. Date: Jul. 27, 2017

(65) Prior Publication Data

US 2019/0022655 A1 Jan. 24, 2019

Related U.S. Application Data

(60) Provisional application No. 62/302,948, filed on Mar. 3, 2016, provisional application No. 62/281,879, filed on Jan. 22, 2016.

(51) Int. Cl.

| | |
|---|---|
| ***B01L 3/00*** | (2006.01) |
| ***F17D 1/16*** | (2006.01) |
| *F15D 1/00* | (2006.01) |

(52) U.S. Cl.
CPC ..... *B01L 3/502792* (2013.01); *F17D 1/16* (2013.01); *B01L 2300/161* (2013.01); *B01L 2400/0436* (2013.01); *F15D 1/00* (2013.01)

(58) Field of Classification Search
CPC ..... F17D 1/16; F17D 1/08; F17D 1/00; B01L 3/502792; B01L 3/502784;
(Continued)

(56) References Cited

U.S. PATENT DOCUMENTS

| | | |
|---|---|---|
| 6,773,566 B2 | 8/2004 | Shenderov |
| 8,142,168 B2 | 3/2012 | Bohringer et al. |

(Continued)

OTHER PUBLICATIONS

Duncombe, Droplet Transport on Flat Checmically Heterogeneous Surfaces via Periodic Wetting Barrier and Vibration, IEEE, 2010, p. 1043-1046. (Year: 2010).*

(Continued)

*Primary Examiner* — Christine T Mui
(74) *Attorney, Agent, or Firm* — Christensen O'Connor Johnson Kindness PLLC

(57) ABSTRACT

In order to expand capabilities of anisotropic ratchet conveyor (ARC) systems beyond those of the simple systems that include only a single track of consistent rung spacing, disclosed herein are ARC devices, systems, and methods related to ARC gates that can selectively pause droplet transport; ARC switches that can select the direction of droplet transport between two tracks, each moving away from an intersection between the two tracks; and ARC junctions that can move a droplet towards, and then through, an intersection between two tracks.

20 Claims, 13 Drawing Sheets

(58) Field of Classification Search
CPC .. B01L 3/502769; B01L 3/5027; B01L 3/502; B01L 3/50; B01L 2300/161; B01L 2300/16; B01L 2300/00; B01L 2400/0436; B01L 2400/0433; B01L 2400/0403; B01L 2400/04; F15D 1/00
USPC ..... 422/504, 50
See application file for complete search history.

(56) References Cited

U.S. PATENT DOCUMENTS

| | | | | |
|---|---|---|---|---|
| 9,279,435 | B2 * | 3/2016 | Bohringer | B01L 3/50273 |
| 9,279,436 | B2 | 3/2016 | Bohringer et al. | |
| 9,795,966 | B2 * | 10/2017 | Umbanhowar | B01L 3/502792 |
| 2012/0318369 | A1 * | 12/2012 | Bohringer | B01L 3/502792 137/13 |
| 2013/0008794 | A1 | 1/2013 | Wen et al. | |
| 2013/0330247 | A1 | 12/2013 | Wilson et al. | |
| 2014/0017457 | A1 | 1/2014 | Megaridis et al. | |
| 2014/0144518 | A1 | 5/2014 | Bohringer et al. | |
| 2014/0319237 | A1 | 10/2014 | Brothier et al. | |

OTHER PUBLICATIONS

Shastry, Directing Droplets Using Microstructured Surfaces, Langmuir, 2006, 22, pp. 6161-61667. (Year: 2006).*

International Preliminary Report on Patentability dated Aug. 2, 2018, issued in corresponding International Application No. PCT/US2017/14529, filed Jan. 23, 2017, 8 pages.

Abdelgawad, M., and A.R. Wheeler, "The Digital Revolution: A New Paradigm for Microfluidics," Advanced Materials 21(8):920-925, 2009.

Agapov, R.L., et al., "Length Scale Selects Directionality of Droplets on Vibrating Pillar Ratchet," Advanced Materials Interfaces 1(9):1400337, 2014, 8 pages.

Anna, S.L., et al., "Formation of Dispersions Using 'Flow Focusing' in Microchannels," Applied Physics Letters 82:364-366, Jan. 2003.

Brouzes, E., et al., "Droplet Microfluidic Technology for Single-Cell High-Throughput Screening," Proceedings of the National Academy of Scienses of the USA (PNAS) 106(34):14195-14200, Aug. 2009.

Casadevall I Solvas, X., et al., "Droplet Microfluidics: Recent Developments and Future Applications," Chemical Communications 47(7):1936-1942, Feb. 2011.

Cheow, L.F., et al., "Digital Microfluidics: Droplet Based Logic Gates," Applied Physics Letters 90(5):054107, Jan. 2007, 3 pages.

Daw, R., and J. Finkelstein, "Lab on a Chip," Nature 442(7101):367, Jul. 2006, 1 page.

Dittrich, P.S., et al., "Micro Total Analysis Systems. Latest Advancements and Trends," Analytical Chemistry 78(12):3887-3908, Jun. 2006.

Dong, Y., "Converting Vertical Vibration of a Texture Ratchet Into Horizontal Drop Motion," Dissertation, University of Washington, Seattle, 2012, 66 pages.

Duncombe, T.A., et al., "Controlling Liquid Drops With Texture Ratchets," Advanced Materials 24(12):1545-1550, Mar. 2012.

Duncombe, T.A., et al., "Directed Drop Transport Rectified From Orthogonal Vibrations via a Flat Wetting Barrier Ratchet," Langmuir 28(38):13765-13770, Sep. 2012.

Fu, E., et al., "Transport in Two-Dimensional Paper Networks," Microfluidics and Nanofluidics 10(1):29-35, Jan. 2011.

Holmes, H.R., and K.F. Böhringer, "Transporting Droplets Through Surface Anisotropy," Microsystems & Nanoengineering 1:15022, Sep. 2015, 8 pages.

Holmes, H.R., et al., "Timing and Synchronization of Droplets on Ratchet Conveyors," Proceedings of the 2016 IEEE 29th International Conference on Micro Electro Mechanical Systems (MEMS), Jan. 24-28, 2016, Shanghai, 4 pages.

Huebner, A., et al., "Quantitative Detection of Protein Expression in Single Cells Using Droplet Microfluidics," Chemical Communications 12:1218-1220, Mar. 2007.

Lin, T.-H., and D.-J. Yao, "Applications of EWOD Systems for DNA Reaction and Analysis," Journal of Adhesion Science and Technology 26(12-17):1789-1804, May 2012.

Malvadkar, N.A., et al., "An Engineered Anisotropic Nanofilm With Unidirectional Wetting Properties," Nature Materials 9(12):1023-1028, Dec. 2010.

Mao, X., and T.J. Huang, "Microfluidic Diagnostics for the Developing World," Lab on a Chip 12(8):1412-1416, Apr. 2012.

Mazutis, L., et al., "Single-Cell Analysis and Sorting Using Droplet-Based Microfluidics," Nature Protocols 8(5):870-891, May 2013.

McHale, G., et al., "Levitation-Free Vibrated Droplets: Resonant Oscillations of Liquid Marbles," Langmuir 25(1):529-533, Jan. 2008.

Mosadegh, B., et al., "Integrated Elastomeric Components for Autonomous Regulation of Sequential and Oscillatory Flow Switching in Microfluidic Devices," Nature Physics 6(6):433-437, Jun. 2010.

Noblin, X., et al., "Vibrated Sessile Drops: Transition Between Pinned and Mobile Contact Line Oscillations," European Physical Journal E—Soft Matter 14(4):395-404, Aug. 2004.

Noblin, X., et al., "Vibrations of Sessile Drops," European Physical Journal Special Topics 166(1):7-10, Jan. 2009.

Ozkumur, E., et al., "Inertial Focusing for Tumor Antigen-Dependent and -Independent Sorting of Rare Circulating Tumor Cells," Science Translational Medicine 5(179):179ra47, Apr. 2013, 13 pages.

Pollock, N.R., et al., "A Paper-Based Multiplexed Transaminase Test for Low-Cost, Point-of-Care Liver Function Testing," Science Translational Medicine 4(152):152ra129, Sep. 2012, 12 pages.

Prakash, "Microfluidic Bubble Logic," Science 315(5813):832-835, Feb. 2007.

Sekeroglu, K., "Applications of Asymmetric Nanotextured Parylene Surface Using Its Wetting and Transport Properties," Dissertation, Pennsylvania State University, University Park, Penn., 2013, 115 pages.

Sharp, J.S., et al., "Contact Angle Dependence of the Resonant Frequency of Sessile Water Droplets," Langmuir 27(15):9367-9371, Aug. 2011.

Stone, H.A., et al., "Engineering Flows in Small Devices: Microfluidics Toward a Lab-On-A-Chip," Annual Review of Fluid Mechanics 36:381-411, 2004.

Suh, Y.K., and S. Kang, "A Review on Mixing in Microfluidics," Micromachines 1(3):82-111, Sep. 2010.

Teh, S.-Y., et al., "Droplet Microfluidics," Lab on a Chip 8(2):19-220, Feb. 2008.

Theberge, A.B., et al., "Microdroplets in Microfluidics: An Evolving Platform for Discoveries in Chemistry and Biology," Angewandte Chemie International Edition 49(34):5846-5868, Aug. 2010.

Thiele, U., and K. John, "Transport of Free Surface Liquid Films and Drops by External Ratchets and Self-Ratcheting Mechanisms," Chemical Physics 375(2-3):578-586, Oct. 2010.

Thorsen, T., et al., "Dynamic Pattern Formation in a Vesicle-Generating Microfluidic Device," Physical Review Letters 86(18):4163-4166, Apr. 2001.

Thorsen, T., et al., "Microfluidic Large-Scale Integration," Science 298(5593):580-584, Oct. 2002.

Umbanhowar, P.B., et al., "Monodisperse Emulsion Generation via Drop Break Off in a Coflowing Stream," Langmuir 16(2):347-351, Jan. 2000.

Unger, M.A., et al., "Monolithic Microfabricated Valves and Pumps by Multilayer Soft Lithography," Science 288(5463):113-116, Apr. 2000.

Varel, C., and K.F. Böhringer, "Liquid Droplet Micro-Bearings on Directional Circular Surface Ratchets," Proceedings of the 2014 IEEE 27th International Conference on Micro Electro Mechanical Systems (MEMS), Jan. 26-30, 2014, San Francisco, 4 pages.

Volpatti, L.R., and A.K. Yetisen, "Commercialization of Microfluidic Devices," Trends in Biotechnology 32(7):347-350, Jul. 2014.

Vukasinovic, B., et al., "Dynamics of a Sessile Drop in Forced Vibration," Journal of Fluid Mechanics 587:395-423, 2007.

(56) References Cited

OTHER PUBLICATIONS

Wee, K.W., et al., "Novel Electrical Detection of Label-Free Disease Marker Proteins Using Piezoresistive Selfsensing Micro-Cantilevers," Biosensors and Bioelectronics 20(10):1932-1938, Apr. 2005.
Whitesides, G.M., "The Origins and the Future of Microfluidics," Nature 442(7101):368-373, Jul. 2006.
Xuan, X., et al., "Particle Focusing in Microfluidic Devices," Microfluidics and Nanofluidics 9(1):1-16, Jul. 2010.
Yetisen, A.K., et al., "Paper-Based Microfluidic Point-Of-Care Diagnostic Devices," Lab on a Chip 13(12):2210-2251, Jun. 2013.
Holmes, H.R., and K.F. Böhringer, "Transporting Droplets Through Surface Anisotropy," Microsystems & Nanoengineering 1:15022, Sep. 2015, pp. 1-8.
International Search Report and Written Opinion dated Apr. 20, 2017, issued in corresponding International Application No. PCT/US2017/14529, filed Jan. 23, 2017, 9 pages.

* cited by examiner 8.3% DUTY CYCLE 16.6% DUTY CYCLE 8.3%→16.6%

16.6%→8.3%

| ACCELERATION AMPITUDE (g) | 4 g | 8.5 g |
|---|---|---|
| LEADING EDGE SPREAD (μm) | 373.6±2.5 | 305.5±36.9 |
| LEADING EDGE SLIP (μm) | -371.0±4.3 | -197.3±35.9 |
| TRAILING EDGE SPREAD (μm) | -628.6±7.4 | -768.2±27.5 |
| TRAILING EDGE SLIP (μm) | 621.6±2.5 | 841.6±8.9 |
| NET TRANSPORT (μm) | -2.6±6.6 | 90.8±41.7 |

CONTACT-LINE-DRIVEN MICROFLUIDIC DEVICES AND METHODS

CROSS-REFERENCES TO RELATED APPLICATIONS

This application claims the benefit of U.S. Provisional Application Nos. 62/281,879, filed Jan. 22, 2016, and 62/302,948, filed Mar. 3, 2016, the disclosures of which are expressly incorporated herein by reference in their entirety.

STATEMENT OF GOVERNMENT LICENSE RIGHTS

This invention was made with Government support under Contract No. ECCS 1308025 awarded by the National Science Foundation. The Government has certain rights in the invention.

BACKGROUND

Anisotropic ratchet conveyors (ARCs) are a type of digital microfluidic (DMF) system that can transport an individual liquid droplet or many droplets in parallel through a passive micropatterned surface and applied orthogonal vibrations. The functionality of ARC devices comes from two primary features: 1) an anisotropic surface pattern of periodically occurring curved structures or "rungs," and 2) oscillation of the contact line or "footprint" of the droplet on the substrate, induced by the applied orthogonal vibrations. The asymmetry of the surface pattern creates a difference in pinning forces between leading and trailing edges of the droplet. The applied vibrations cycle the contact line between wetting, de-wetting, and equilibrium phases. This combination produces a net force in the direction of the leading edge, which essentially causes the droplet to take a step through each vibration cycle (FIG. 1).

ARCs are disclosed in U.S. Pat. No. 8,142,168 ("the '168 Patent"), directed to ARCs formed in a Fakir state (arcuate projections extending from a surface). The '168 Patent introduces the concept of contact-line pinning and movement of a droplet induced by vibration of an anisotropically patterned track on the surface. The ARC concept is further disclosed in U.S. Pat. No. 9,279,435 ("the '435 Patent"), which discloses anisotropic tracks patterned via surface chemistry modification instead of physically textured features. In particular, in the '435 Patent the ARC devices are optically flat tracks formed by patterning hydrophilic arcuate rungs in a hydrophobic material. These patents disclose tracks of consistent (unvarying) rung spacing (also referred to as "duty cycle"), which limit the disclosed ARCs to the function of moving a droplet along the defined track of rungs. No further functionality is disclosed. Both the '435 Patent and the '168 Patent are expressly incorporated herein by reference in their entirety.

While ARCs do not offer the robust programmability available to electrowetting based DMF systems, this platform provides the ability to handle liquid droplets with a passive surface pattern and a simple driving system (e.g. a speaker). Like electrowetting on dielectric (EWOD) systems, the ability of ARCs to handle liquid in the form of discrete droplets can reduce required sample volumes and reagent quantities compared to continuous flow devices. Droplets also provide a form of 'compartmentalization', wherein the contents of each droplet are individually isolated, preventing undesirable interactions between samples or reagents. Furthermore, the simple microelectromechanical systems (MEMS) based fabrication process allows for high-throughput manufacturing of ARC devices, which could provide for inexpensive ARC chips with integrated MEMS components or electronic sensors. Such a system could fill the niche for diagnostic or analytic applications that require more process control or measurement accuracy than paper-based or passive microfluidic systems. For example, ARCs present the potential to address unmet needs of a point-of-care platform for lateral-flow tests with improved clinical utility, or for molecular (nucleic acid) diagnostics that are less expensive and more easily deployable. Additionally, ARCs could provide a useful research tool, such as in applications for automating protein or nucleic acid purification.

However, before any applications for an automated ARC platform can be realized, the functional toolbox available to ARC systems must be expanded.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In one aspect, an ARC including a "gate" device element is provided. In one embodiment, the device is configured to move a droplet along a track on a surface, the device comprising a surface having a track comprising a plurality of transverse arcuate regions having a different degree of hydrophobicity than a surrounding region;

wherein the transverse arcuate regions are sized and spaced to induce asymmetric contact angle hysteresis when the droplet is vibrated; and wherein the plurality of transverse arcuate regions includes a gate comprising a first set of transverse arcuate regions having a first duty cycle and a second set of transverse arcuate regions having a second duty cycle that is less than the first duty cycle, such that, when the droplet is vibrated, greater vibration signal is required to move the droplet in the second set of transverse arcuate regions compared to the first set of transverse arcuate regions.

In another aspect, ARC devices are provided that include two tracks, sometimes referred to as a first track and a second track, which intersect at an intersection. Embodiments of this aspect include both junctions, which move a droplet towards and through the intersection, and switches, which controllably direct a droplet either through the switch on its original track or transfers the droplet to a second track, both functionalities move the droplet away from the intersection.

Junctions and switches are generically referred to as "intersection" or "intersecting track" devices. Generally, intersecting track embodiments include a device configured to move a droplet on a surface between a first track and a second track, the device comprising a surface comprising:

a first track comprising a plurality of transverse arcuate regions having a different degree of hydrophobicity than a surrounding region;

a second track comprising a plurality of transverse arcuate regions having a different degree of hydrophobicity than the surrounding region, wherein the transverse arcuate regions of the first track and the second track are sized and spaced to induce asymmetric contact angle hysteresis when the droplet is vibrated; and an intersection between the first track and the second track, wherein the intersection is configured to selectively transition the droplet between the first track and the second track under specific vibration characteristics.

In another aspect, methods of moving a droplet on a track are provided. Particularly, any of the devices disclosed herein are compatible with the methods. In one embodiment, the method includes:

depositing the droplet on the track such that a front portion of the droplet contacts a first of the plurality of arcuate regions of the track; and vibrating the droplet at a frequency and amplitude sufficient to cause the droplet to deform such that the front portion of the droplet contacts a second of the plurality of arcuate regions of the track, thereby urging the droplet towards the second of the plurality of arcuate regions.

In yet another aspect, a system is provided that includes at least two device elements, of the type disclosed herein, selected from the group consisting of a loop, a gate, a junction, and a switch, such that the at least two device elements are configured to manipulate the same droplet when operated.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

In order to expand capabilities of anisotropic ratchet conveyor (ARC) systems beyond those of the simple systems that include only a single track of consistent rung spacing, disclosed herein are ARC devices, systems, and methods related to ARC gates that can selectively pause droplet transport; ARC switches that can select the direction of droplet transport between two tracks, each moving away from an intersection between the two tracks; and ARC junctions that can move a droplet towards, and then through, an intersection between two tracks. In electrowetting systems, these functions are innately enabled by the position of electrodes, with respect to the droplets, being activated. On ARC systems, functionality is dictated by the design of the passive surface pattern. Therefore each droplet function on ARC systems must be enabled with a specific design strategically placed on chip.

Each of the three main device types, gates, junction, and switches will now be described in greater detail. All devices operate based on the basic principles disclosed in the '435 Patent and the '168 Patent. In particular, the devices include two or more "tracks," each formed from a plurality of transverse arcuate regions having a different degree of hydrophobicity than a surrounding region. Each transverse arcuate region is more hydrophilic than the surrounding region, such that a water droplet will preferentially "pin" to the transverse arcuate region. The transverse arcuate regions are the "rungs" of the track. The area of the track between the rungs is the "surrounding region" and is less hydrophilic (more hydrophobic) than the rungs.

Figure 1A:
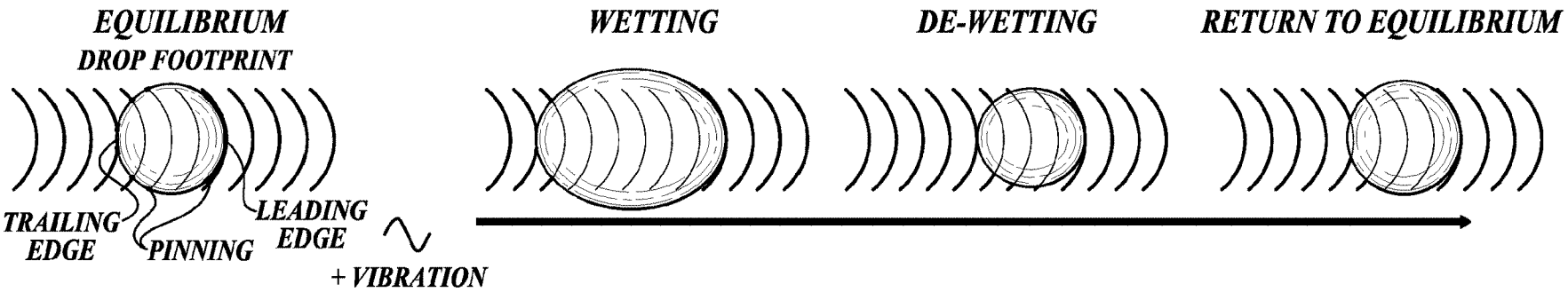
FIG. 1: Principles of ARC functionality. ARC systems transport droplets through an anisotropic surface pattern composed of periodically occurring curved rungs (black) defined by a hydrophobic background (white). This asymmetric geometry creates a difference in pinning between leading and trailing edges of the contact line or 'footprint' of the droplet (1A). Applied orthogonal vibrations induce the contact line to oscillate between wetting, de-wetting and equilibrium states (1B-1D). This combination results in a net force through each vibration cycle that transports droplets.
Figure 1B:
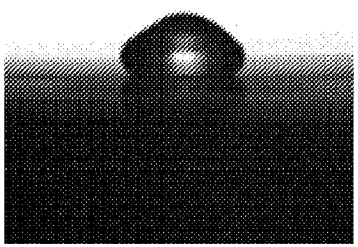
Figure 1C:
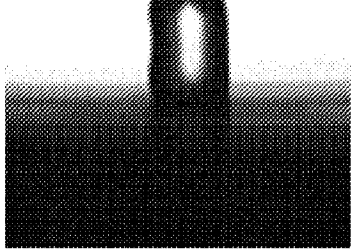
Figure 1D:
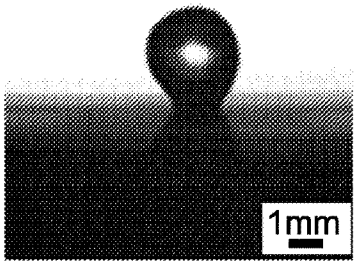
Figure 2A:
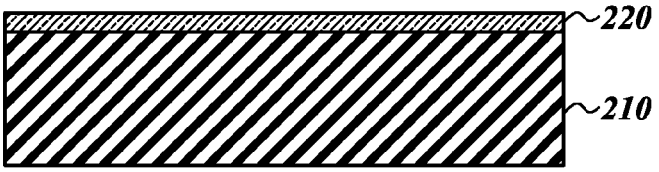
FIG. 2: ARC fabrication and duty cycle. $SiO_2$-FOTS ARCs are fabricated on a silicon wafer with an $SiO_2$ surface layer (2A). The ARC design is patterned with photoresist (2B) and the wafer is coated with FOTS (2C). Stripping the resist reveals the hydrophilic $SiO_2$ pattern (2D). Rung duty cycle is defined as the width of the rungs (10 μm) divided by the period between rungs. For example, a 120 μm period (2E) provides a duty cycle of 8.3%.
Figure 2B:
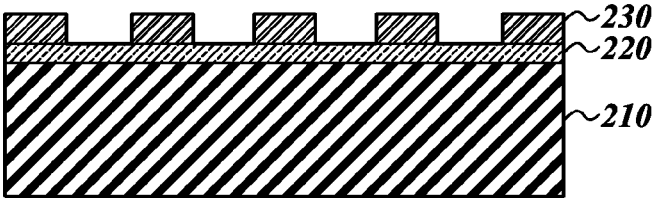
Figure 2C:
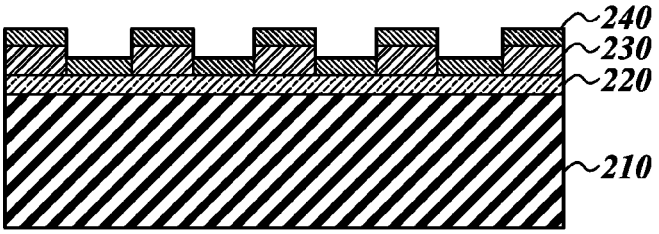
Figure 2D:
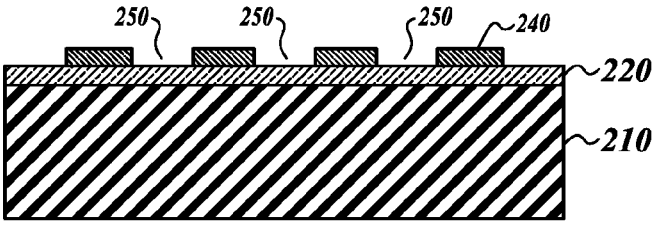
Figure 2E:
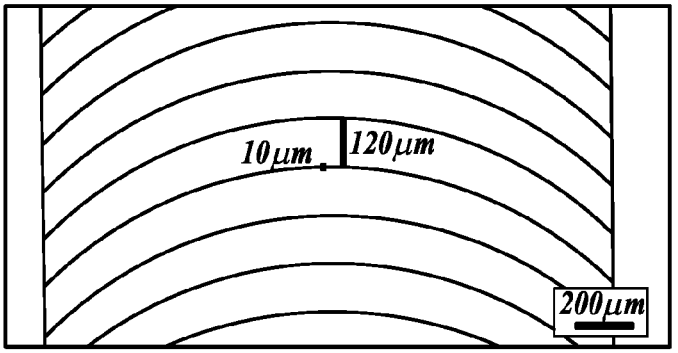

Turning to FIGS. 2A-2E, an exemplary device fabrication process is illustrated. In FIG. 2A, a silicon substrate 210 is provide, with a silicon oxide layer 220 on the exposed upper surface. In FIG. 2B, the rung pattern is defined in photoresist 230. In FIG. 2C, a hydrophobic monolayer 240 is deposited across the entire die. After removing the photoresist 230, FIG. 2D illustrates the final form, with the rungs 250 defined in the silicon oxide 220 in the interstitial areas between the hydrophobic monolayer 240 (which define the surrounding regions). FIG. 2E illustrates an exemplary track of rungs, with each rung having a width of 10 microns and the spacing between the rungs at 120 microns.

It will be appreciated that the exemplary device configurations illustrated herein are only representative embodiments of the materials and designs useful to form devices according to the present aspects and embodiments. In this regard, for example, the rungs can be formed from non-continuous regions (e.g., a dashed line or series of circles), the rungs can be a material deposited on top of a hydrophobic material, and/or the rungs can be textured so as to project beyond the hydrophobic surrounding regions.

The devices operate by vibrating a droplet with a vibration signal, which is characterized herein in terms of both vibration acceleration amplitude (defined in terms of displacement, e.g., mm, or in multiples of gravity, "g") and frequency (Hz). The "g" is acceleration in times gravity. Acceleration related to gravity is used to account for the energy input to the system. Acceleration is related to displacement through a second derivative/integral. For instance with a vibration of A*sin(wt) the displacement is A m (w=frequency and t=time). The second derivative of this function is −A*w^2*sin(wt) and the acceleration amplitude is (A*w^2)/9.8 g. This may seem trivial, but is important because, for example, a 30 Hz vibration with a 2 mm displacement (~4 g) requires much less energy than a 100 Hz vibration with a 100 μm displacement (~5.5 g).

Figure 3A:
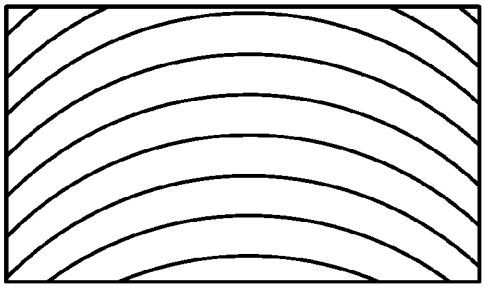
FIG. 3: Rung duty cycle modulates ARC threshold. The ARC threshold for vibration induced transport of 10 μL $diH_2O$ droplets was measured on ARC tracks with 8.3% (3A) and 16.6% (3B) duty cycles, and transitions from 8.3% to 16.6% (3C) and 16.6% to 8.3% (3D). Only the transition from 16.6% to 8.3% required a significantly higher ARC threshold at frequencies above 60 Hz (3E). The dotted black line indicates 70 Hz response used in subsequent experiments. Scale bar=200 μm.
Figure 3B:
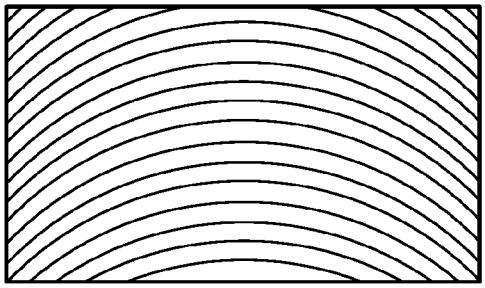
Figure 3C:
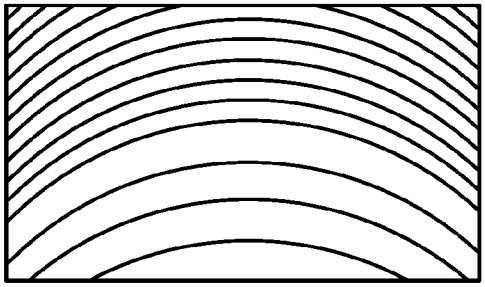
Figure 3D:
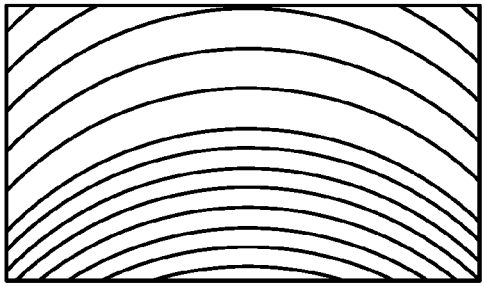
Figure 3E:
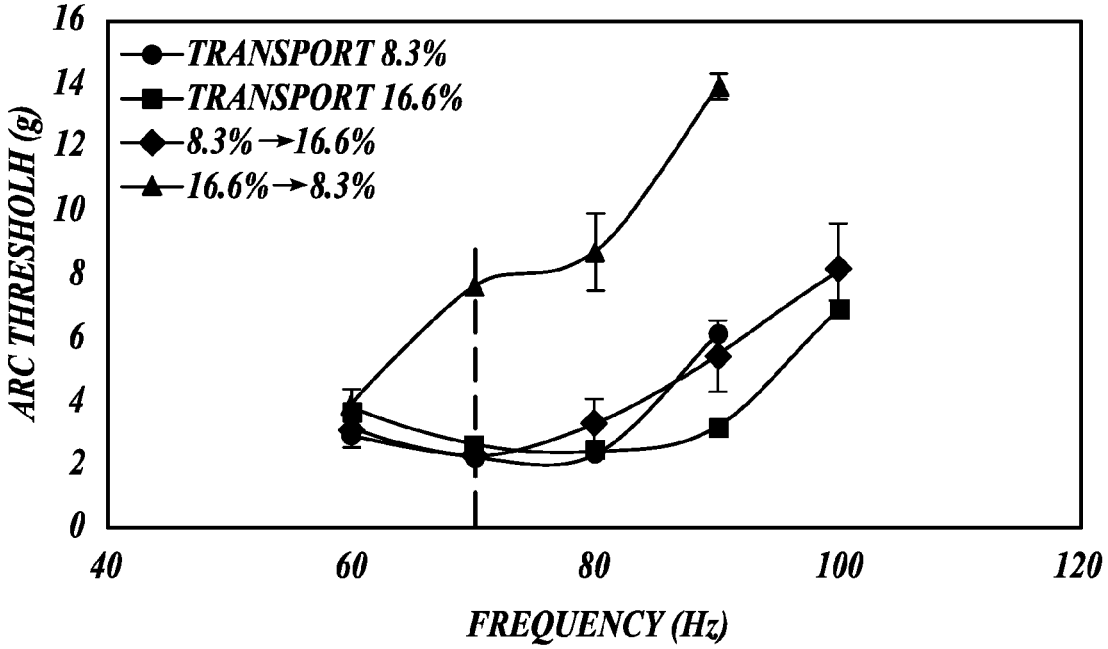

As an example, FIG. 3E illustrates a number of devices characterized according to their threshold (i.e., the acceleration required to induce droplet movement also referred to herein as "ARC threshold").

The devices can transport any size of droplet, as long as sufficient pinning of the droplet edge can be achieved so as to produce the desired movement via asymmetric contact angle hysteresis. Droplet volumes in the exemplary embodiments disclosed herein are on the order of 1 μL to 50 μL.

The EXAMPLES below describe the fabrication and operation of ARC devices in greater detail. FIGS. 1A-4C illustrate fundamental device concepts and characterization.

As used herein, the term "duty cycle" is defined as the width of the rung (hydrophilic portion) divided by the period of the rungs (center to center distance between rungs). Illustrated in FIG. 2E is a device with a duty cycle of 8.3% (10 microns/120 microns=0.083=8.3%).

Furthermore, any approximate terms, such as "about," "approximately," and "substantially," indicate that the subject can be modified by plus or minus 5% and fall within the described embodiment.

ARC Gates

In one aspect, an ARC including a "gate" device element is provided. In one embodiment, the device is configured to move a droplet along a track on a surface, the device comprising a surface having a track comprising a plurality of transverse arcuate regions having a different degree of hydrophobicity than a surrounding region;

wherein the transverse arcuate regions are sized and spaced to induce asymmetric contact angle hysteresis when the droplet is vibrated; and wherein the plurality of transverse arcuate regions includes a gate comprising a first set of transverse arcuate regions having a first duty cycle and a second set of transverse arcuate regions having a second duty cycle that is less than the first duty cycle, such that, when the droplet is vibrated, greater vibration signal is required to move the droplet in the second set of transverse arcuate regions compared to the first set of transverse arcuate regions.

The gate is a device that allows for control of droplet transportation along a single track only when the proper vibration signal is applied. In the present embodiments, this gating is provided by a change in duty cycle between the rungs on the track, transitioning from a larger to a smaller duty cycle. The smaller duty cycle portion has more distance between rungs and therefore requires greater vibration signal to extend the droplet edge to pin to the next rung in succession. Accordingly, a gate is simply defined by a change to a smaller duty cycle.

The fabrication and operation of ARC gates are described in greater detail in the EXAMPLES below. Gates are particularly illustrated in FIGS. 5A-7B. Referring particularly to FIGS. 5A-5F, a series of micrographs show gates on three adjacent tracks operating on similar droplets. From FIG.

5A-5E the droplets move along their tracks, at a consistent vibration signal of 70 Hz and 4 g, until all three are trapped at the gate on their individual tracks. The three droplets are then urged past the gates by increasing the acceleration to 8.5 g, sufficient to overcome the change to smaller duty cycle beyond the gate.

ARC Intersecting Track Devices: Junctions and Switches

In another aspect, ARC devices are provided that include two tracks, sometimes referred to as a first track and a second track, which intersect at an intersection. Embodiments of this aspect include both junctions, which move a droplet towards and through the intersection, and switches, which controllably direct a droplet either through the switch on its original track or transfers the droplet to a second track, both functionalities move the droplet away from the intersection.

Junctions and switches are generically referred to as "intersection" or "intersecting track" devices. Generally, intersecting track embodiments include a device configured to move a droplet on a surface between a first track and a second track, the device comprising a surface comprising:

a first track comprising a plurality of transverse arcuate regions having a different degree of hydrophobicity than a surrounding region;

a second track comprising a plurality of transverse arcuate regions having a different degree of hydrophobicity than the surrounding region, wherein the transverse arcuate regions of the first track and the second track are sized and spaced to induce asymmetric contact angle hysteresis when the droplet is vibrated; and an intersection between the first track and the second track, wherein the intersection is configured to selectively transition the droplet between the first track and the second track under specific vibration characteristics.

Generally, the duty cycle of the first track and the second track can be the same or different. As disclosed herein, altering the duty cycle between track can lead to desirable device properties, such as selective transport between tracks in a gate. In one embodiment the duty cycle of the first track is the same as the duty cycle of the second track, in the immediate vicinity (e.g., within a droplet diameter) of the intersection. In another embodiment, the first track includes a first portion having a first duty cycle and the second track includes a second portion having a second duty cycle that is different than the first duty cycle. That is, the two tracks have different duty cycles, thereby leading to switch-like behavior. In a further embodiment, the first portion and the second portion are adjacent the intersection, such that during operation the droplet is transferred between the first portion and the second portion.

ARC Junctions

In certain embodiments, the "intersecting" devices are ARC Junctions. In such embodiments of the devices, the intersection is a junction configured to selectively transition a droplet from the second track to the first track, wherein the second track is configured to direct the droplet towards the junction. Junctions are distinct from switches in several ways, the most prominent of which is that junctions move a droplet towards an intersection on a second track, through the intersection, and then away from the intersection on the first track. Switches move a droplet towards an intersection but then controllably determine, based on vibration signal, whether the droplet proceeds away from the junction on the first track or the second track.

Figure 9A:
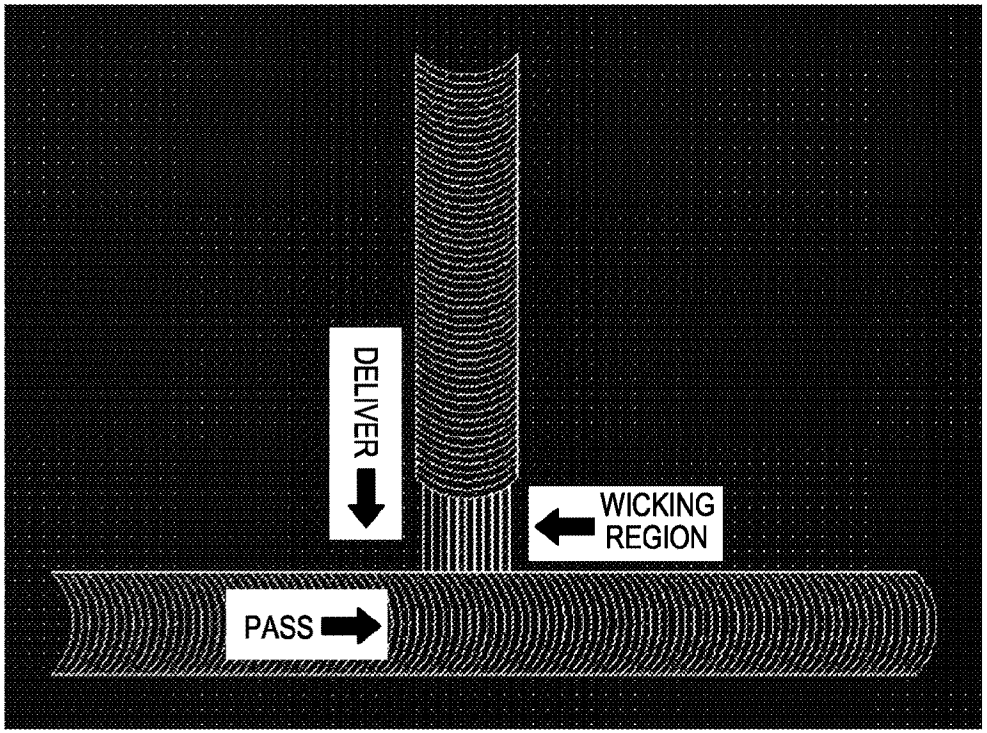
FIG. 9A illustrates an ARC junction device. This device comprises two tracks with the same duty cycle (8.3% as pictured), separated by a wicking region. The secondary (second) track is perpendicular and directed toward the wicking region and main (first) track. These features allow the secondary track to deliver droplets to the main track without preventing droplets on the main track from passing past the junction.

Junctions may be better understood as including a "pass" (first) track intersected by a "deliver" (second) track. FIG. 9A illustrates a representative junction device. The deliver track includes rungs configured to move a droplet towards the intersection. A "wicking" region terminates the deliver track at the junction with the pass track. Upon application of a sufficient vibration signal (see FIG. 9B), the droplet will cross the wicking region and enter the pass track, possibly joining with another droplet, if the two collide on the pass track. The wicking region does not include rungs bridging the entire space between the deliver track and the pass track, as such a design would potentially interrupt travel of droplets on the pass track moving past the intersection with the junction. Instead, the wicking region includes a plurality of parallel hydrophilic channels (e.g., defined in the same manner as the rungs) bridging the terminal rung of the deliver track and the side of the pass track. This wicking region allows the droplet to physically cross the wicking region and its edge can pin to the rungs in the pass track. Without the wicking region, such as if there were purely hydrophobic surface between the deliver and pass tracks, an exceptionally large vibration signal would be required to greatly deform the droplet sufficiently to induce pinning on the rungs of the pass track. The wicking region reduces the vibration signal required to make the transition between two tracks. As discussed herein with regard to variations on material and configuration of device construction, the wicking region design is not strictly limited to a plurality of parallel lines of hydrophilic material (although that is one embodiment). Non-continuous lines, textured regions, etc. can also be used to facilitate the transition between the tracks and thereby form the wicking region.

Figure 9B:
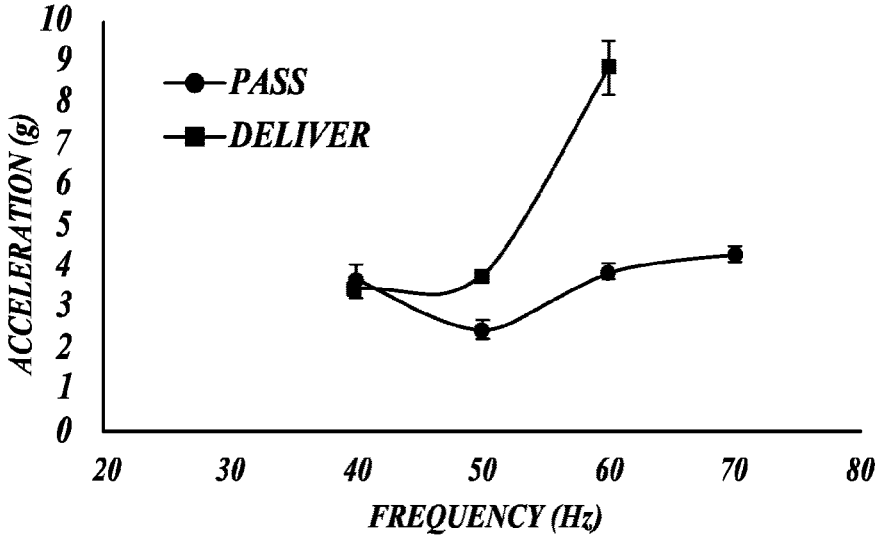
FIG. 9B graphically illustrates operation of these two functions on the device of FIG. 9A.

ARC junctions are discussed in greater detail in the EXAMPLES below. An exemplary junction is illustrated in FIG. 9A and characterized in FIG. 9B. FIG. 9B characterizes a representative junction over a range of frequencies and accelerations for both functions. These plots show the junction can perform both functions at reasonable frequency and amplitude combinations and provide selective control between the functions through vibration parameters. In other words, this device can be controlled to hold droplets on the secondary track at the wicking region while droplets on the main track move past or deliver droplets from the secondary track to the main track while passing droplets on the main track, merging the two droplets at this location. This functionality essential for enabling complex processes on ARC systems, for example junctions also allows droplets from multiple sources (i.e. samples) to be moved on to the same track without impeding the transport of other droplets downstream of the junction.

ARC Switches

In certain embodiments, the "intersecting" devices are ARC Switches. In such embodiments of the devices, the intersection is a switch configured to selectively transition a droplet from the first track to the second track, wherein the second track is configured to direct the droplet away from the junction.

Switches are in some ways the opposite of junctions. A droplet on the main (first) track will pass through the intersection with the second track under certain vibration signals. However, under other vibration signals, a droplet will preferentially pin to the first rungs of the second track and the droplet will switch to the second track and proceed away from the intersection.

Figure 6A:
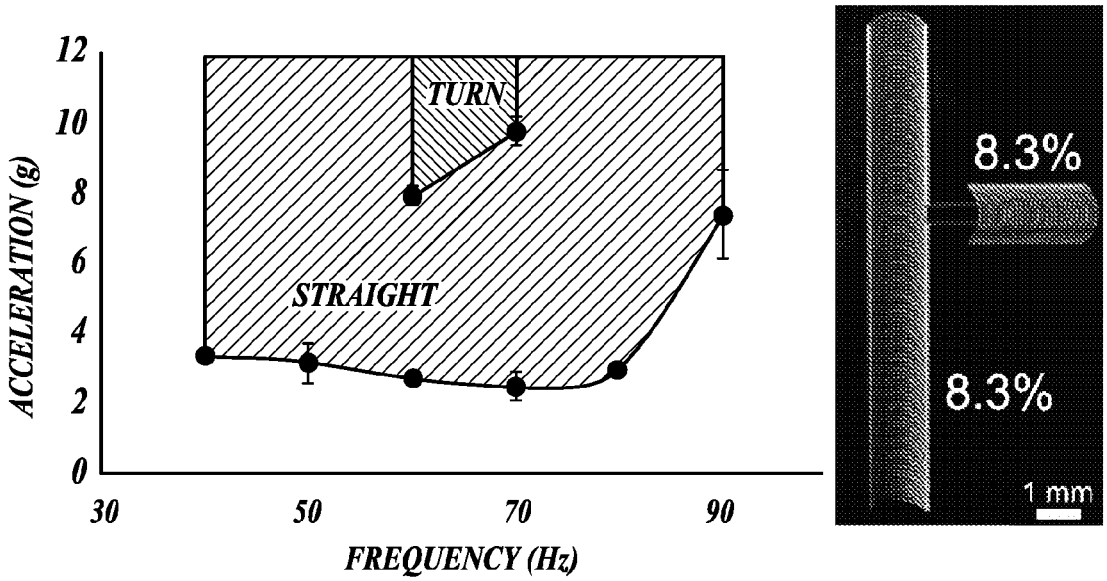
FIG. 6: Perpendicular intersection enables ARC switch. The ARC thresholds for transporting droplets straight through or turning at the intersection were measured for switches having main and perpendicular tracks with 8.3% duty cycle (6A) and a main track of 8.3% with a perpendicular track of 16.6% duty cycle (6B). The increased pinning of the higher duty cycle perpendicular track enabled droplets to turn at much lower vibration amplitudes. Blue regions correspond to vibration parameters that provide a high probability of driving the droplet straight through the intersection, while red regions correspond to parameters that have a high probability of turning the droplet at the intersection. Mixed regions correspond to parameters at which droplets will both pass straight through or turn at the intersection with some unknown probability.
Figure 6B:
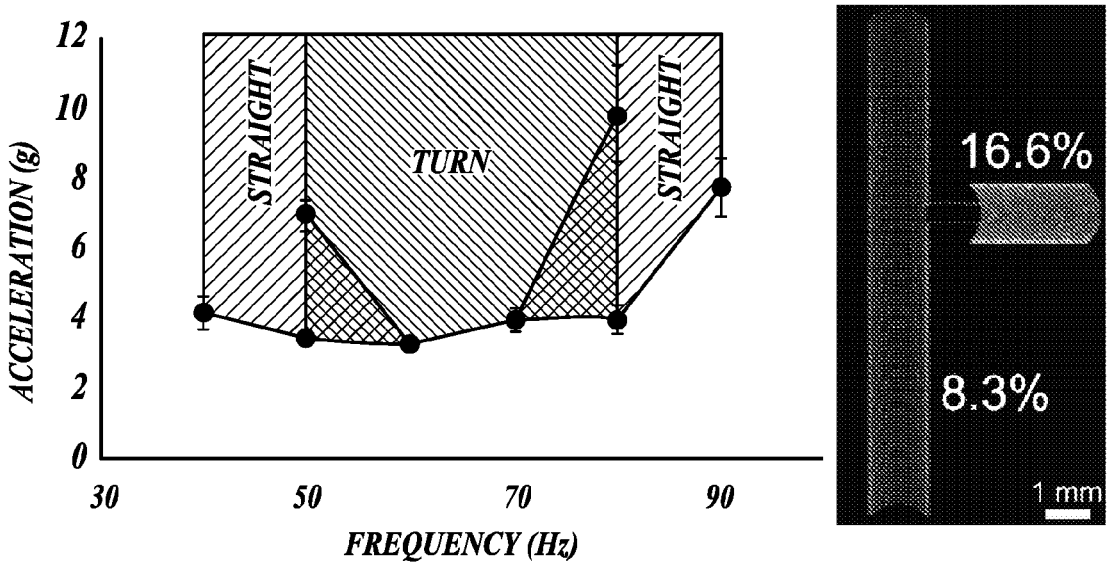
Figure 7A:
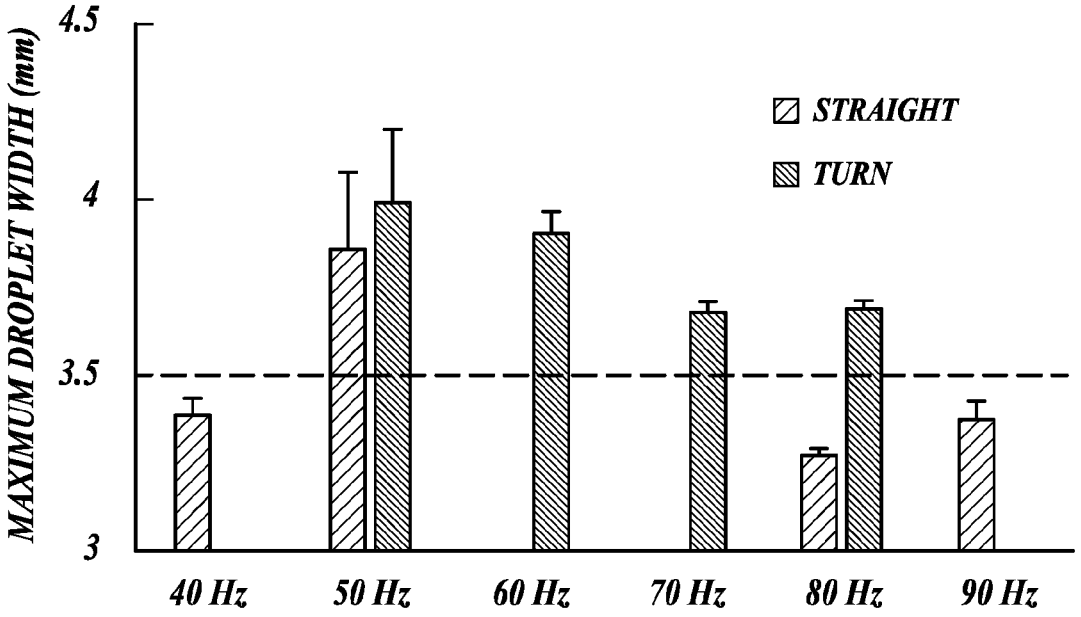
FIG. 7: Turning droplets depends on droplet width and aspect ratio. The length and width (insert) of droplets during maximum wetting were measured for switches with a 16.6% duty cycle perpendicular track. These data indicate that two conditions must be met for a droplet to turn: the width of the droplet during wetting must be large enough to contact the perpendicular track (this distance is indicated by the dotted gray line—7A), and the aspect ratio (7B) must be sufficient for pinning forces on the right edge of the droplet to dominate.
Figure 7B:
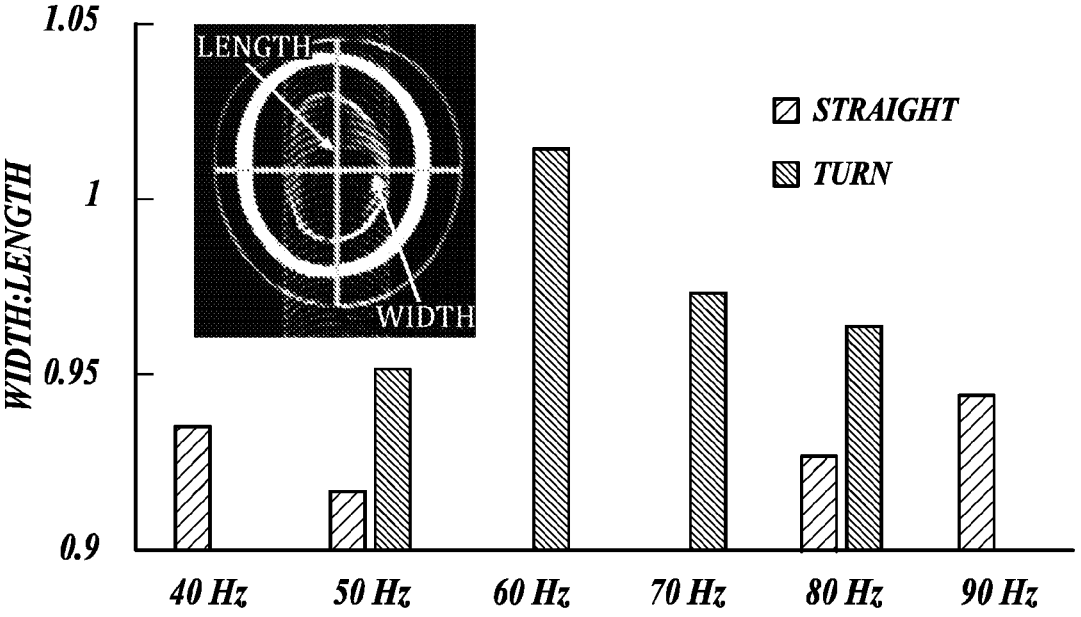

ARC switches are discussed in greater detail in the EXAMPLES below. An exemplary junction is illustrated in FIGS. 8A-8C, 10A, and 10B. As illustrated in FIG. 6A, in one embodiment, the duty cycles of the first track and the second track are the same. In another embodiment, as illustrated in FIG. 6B, the first track and the second track have duty cycles that are different. In one embodiment the duty cycle of the first track is smaller than the duty cycle of the second track. In another embodiment, the duty cycle of the first track is larger than the duty cycle of the second track.

ARC Devices, Generally

The following embodiments related to device characteristics applicable to any of the ARC devices disclosed herein.

In one embodiment, related to any of the proceeding devices, the device further comprises a source of vibratory motion configured to controllably vibrate the droplet. In a further embodiment, the source of vibratory motion is selected from the group consisting of acoustic vibration, electromagnetic vibration, and piezoelectric vibration.

In one embodiment, related to any of the proceeding devices, the plurality of transverse arcuate regions and the surrounding region are optically flat. Such optically flat devices are disclosed in the EXAMPLES below and the '435 Patent. However, in other embodiments, the devices are not optically flat (e.g., "textured") such that the required contact-line pinning is achieved and the ratchet movement of a droplet can be effected by vibrating the droplet. The textured ARCs of the '168 Patent are examples of representative devices.

In one embodiment, related to any of the proceeding devices, the plurality of transverse arcuate regions and the surrounding region are coplanar.

In one embodiment, related to any of the proceeding devices, the plurality of transverse arcuate regions and the surrounding region are formed from the same substrate. In the EXAMPLES, the ARC devices are made from a common substrate, a silicon wafer with a silicon dioxide surface. The surface is functionalized with a hydrophobic monolayer and the rungs of the ARC are defined in the monolayer to expose the hydrophilic silicon dioxide below. In the configuration, the substrate is the same for both regions of the ARC, even though the hydrophobic portion is chemically modified.

In one embodiment, related to any of the proceeding devices, the vibration is at an amplitude in the range of 1 micron to 2 mm. In one embodiment, related to any of the proceeding devices, the vibration is at an amplitude in the range of 1 micron to 1 mm. In one embodiment, related to any of the proceeding devices, the vibration is at an amplitude less than 1 mm.

In one embodiment, related to any of the proceeding devices, the vibration is at a frequency in the range of 1 Hz to 10 kHz. In one embodiment, related to any of the proceeding devices, the vibration is at a frequency in the range of 1 Hz to 1 kHz. In one embodiment, related to any of the proceeding devices, the vibration is at a frequency in the range of 1 Hz to 100 kHz. In one embodiment, related to any of the proceeding devices, the vibration is at a frequency less than 100 kHz.

In one embodiment, related to any of the proceeding devices, the vibration is at a frequency in the range of 1 Hz to 100 kHz and an amplitude in the range of 1 micron to 1 mm.

In one embodiment, related to any of the proceeding devices, the transverse arcuate regions define substantially circular arcs having a constant radius. In one embodiment, the constant radius is approximately equal to a radius of a footprint of the droplet. In one embodiment, the substantially circular arcs are equal to or less than ½ of a circle.

In one embodiment, related to any of the proceeding devices, the plurality of transverse arcuate regions and the surrounding region are transparent at visible wavelengths.

In one embodiment, related to any of the proceeding devices, the droplet has a degree of hydrophobicity closer to the degree of hydrophobicity of the transverse arcuate regions than that of the surrounding region.

In one embodiment, related to any of the proceeding devices, the surrounding region is a hydrophobic material and the transverse arcuate regions are defined in the surrounding region by removing the hydrophobic material to expose a hydrophilic material underneath.

In one embodiment, related to any of the proceeding devices, the substrate is silicon dioxide. In another embodiment, the substrate is selected from the group consisting of silicon, silicon dioxide, glass, PDMS, Parylene, and polystyrene.

In one embodiment, related to any of the proceeding devices, the surrounding region is a fluorinated compound. In another embodiment, the surrounding region is selected from the group consisting of a silanes, an alkane SAM, functionalized PDMS, and Parylene.

Figure 11:
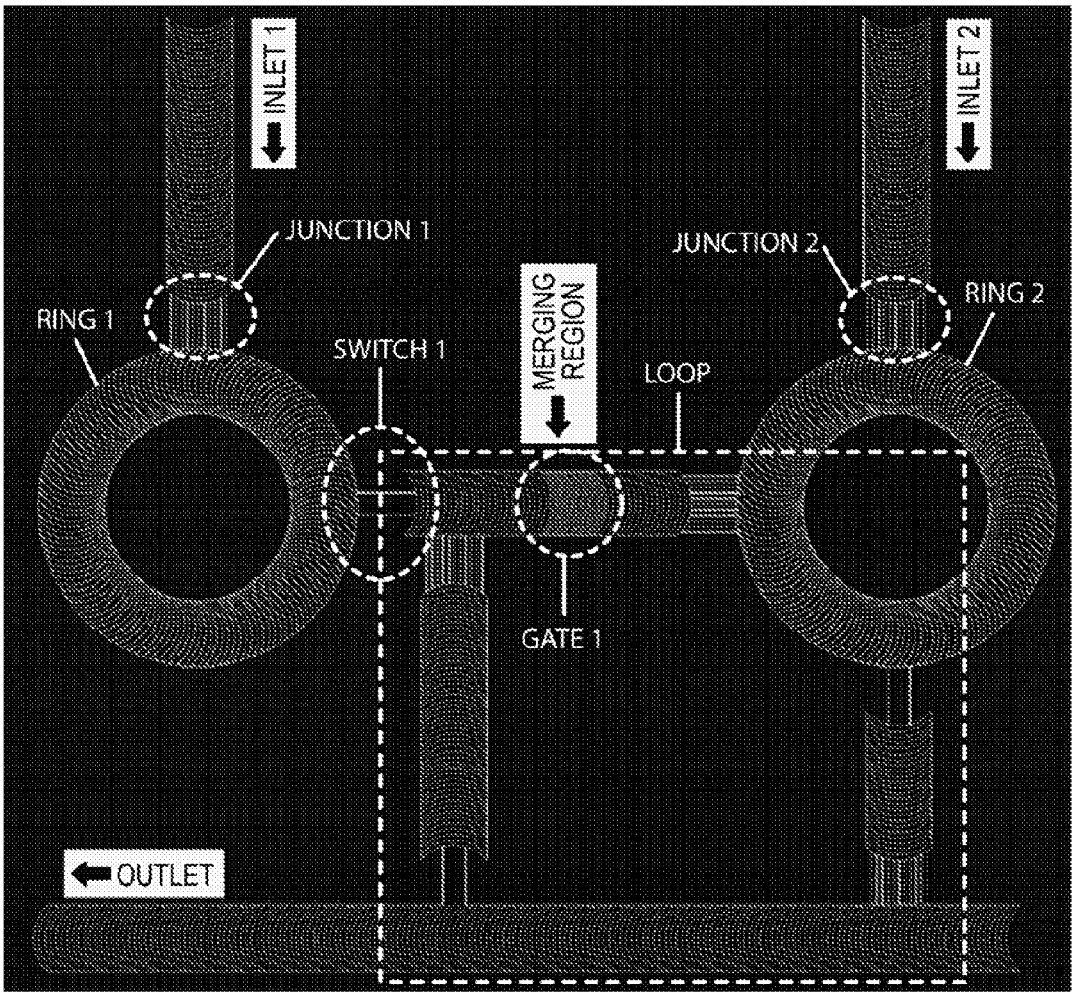
FIG. 11 illustrates an exemplary ARC system that includes multiple inlets, rings, switches, junctions, and gates. The system can combine droplets provided by the two separate inlets and deliver the combined droplet to an outlet.

The fundamental devices disclosed herein, gates, junctions, and switches, can be coupled together to form more complex droplet-transport systems. Any number of these devices can be combined. FIG. 11 is but one example of the types of systems that can be created. In the exemplary system of FIG. 11, the device includes two inlets (INLET 1 and INLET 2), which feed droplets into individual rings (RING 1 and RING 2) via JUNCTION 1 and JUNCTION 2. SWITCH 1 feeds droplets from RING 1 into LOOP 1, which includes junctions, switches, a portion of RING 2, and a "merging region" that includes GATE 1. Using LOOP 1 a combined droplet can be formed by combining a droplet from INLET 1 and a droplet from INLET 2 by merging them at GATE 1. The combined droplet can then be passed out of this portion of the device via the OUTLET.

Accordingly, in one aspect, related to any of the proceeding devices, a system is provided that includes at least two device elements selected from the group consisting of a loop, a gate, a junction, and a switch, such that the at least two device elements are configured to manipulate the same droplet when operated.

In a further embodiment, related to any of the proceeding devices, a system is provided that includes at least three device elements selected from the group consisting of a loop, a gate, a junction, and a switch, such that the at least three device elements are configured to manipulate the same droplet when operated.

In yet a further embodiment, related to any of the proceeding devices, a system is provided that includes a loop, a gate, a junction, and a switch, configured to manipulate the same droplet when operated.

Finally, in certain embodiments, a system is provided that includes a device according to any of the proceeding embodiments and a source of vibratory motion configured to vibrate a droplet on a track of the device so as to induce movement of the droplet on the track. The devices, systems, and sources of vibratory motion are all described elsewhere herein.

Methods of Moving a Droplet on a Track

In another aspect, methods of moving a droplet on a track are provided. Particularly, any of the devices disclosed herein are compatible with the methods. In one embodiment, the method includes:

depositing the droplet on the track such that a front portion of the droplet contacts a first of the plurality of arcuate regions of the track; and vibrating the droplet at a frequency and amplitude sufficient to cause the droplet to deform such that the front portion of the droplet contacts a second of the plurality of arcuate regions of the track, thereby urging the droplet towards the second of the plurality of arcuate regions.

The devices and operating parameters (e.g., frequency and amplitude) are discussed in greater detail elsewhere herein. Any devices and parameters are compatible with the methods, as long as sufficient vibration signal is provided to move the droplet on the track in the desired manner.

In one embodiment, the vibration is at a frequency in the range of 1 Hz to 10 kHz. In one embodiment, related to any of the proceeding devices, the vibration is at a frequency in the range of 1 Hz to 1 kHz. In one embodiment, the vibration is at a frequency in the range of 1 Hz to 100 kHz. In one embodiment, the vibration is at a frequency less than 100 kHz. In one embodiment, the vibration is at a frequency in the range of 1 Hz to 100 kHz and an amplitude in the range of 1 micron to 1 mm.

In one embodiment, the step of vibrating the droplet comprises a technique selected from the group consisting of acoustic vibration, electromagnetic vibration, and piezoelectric vibration.

In one embodiment, the step of vibrating the droplet comprises vibrating the surface.

In one embodiment, the device is a gate and the step of vibrating the droplet further comprises vibrating the droplet at a first vibration signal that is insufficient to move the droplet in the second set of transverse arcuate regions and then vibrating the droplet at a second vibration signal that is sufficient to move the droplet in the second set of transverse arcuate regions, thereby moving the droplet into the second set of transverse arcuate regions.

In one embodiment, the device is a switch and the step of vibrating the droplet comprises vibrating the droplet at a vibration signal sufficient to move the droplet from the first track to the second track, thereby moving the droplet away from the switch on the second track.

In one embodiment, the device is a junction and the step of vibrating the droplet comprises vibrating the droplet at a vibration signal sufficient to move the droplet from the second track to the first track, thereby moving the droplet towards the junction on the second track, through the junction, and then away from the junction on the first track.

The following examples are included for the purpose of illustrating, not limiting, the described embodiments.

EXAMPLES

ARC Gates, Switches, and Junctions

In order to expand capabilities of ARC systems, we developed three new ARC devices: 1) ARC gates that can selectively pause droplet transport; 2) ARC switches that can select the direction of droplet transport between two tracks, each moving away from an intersection between the two tracks; and 3) ARC junctions that can move a droplet towards, and then through, an intersection between two tracks. On ARC systems, functionality is dictated by the design of the passive surface pattern. Therefore each droplet function on ARC systems must be enabled with a specific design strategically placed on chip. The following sections will demonstrate how the design of the surface pattern in ARC gates, ARC switches, and ARC junctions employ the relationship between the applied vibrations and pinning forces acting on a droplet to enable essential functions for automated liquid handling processes on ARC systems.

Design and Fabrication

In this work, ARCs were fabricated on a silicon wafer with an oxide surface (FIG. 2A) by first patterning a photoresist coated on an oxidized silicon wafer (FIG. 2B). A vapor deposition with per-fluorooctyltrichlorosilane (FOTS) is then applied to render all exposed regions hydrophobic (FIG. 2C). Upon stripping the resist with acetone, an optically flat pattern of SiO2 rungs chemically defined by the hydrophobic FOTS is revealed (FIG. 2D). Due to invisibility of the ARC design, all images depicting ARCs were taken prior to resist stripping. Subsequently, images of droplet transport on SiO2-FOTS ARC devices are superimposed with images of the photoresist pattern.

On ARC patterns used in this work, we define rung duty cycle as the width of the rung divided by the period of the rungs (center to center distance between rungs). ARC designs used here consisted of 10 μm wide rungs with a radius of 1000 μm and a period of 60 μm or 120 μm, providing for a duty cycle of 16.6% or 8.3%, respectively (FIG. 2E).

For all experiments in this work 10 μL droplets of deionized water (di$H_2O$) were driven on ARC substrates with sinusoidal vibrations produced by an electromagnetic motor. The acceleration amplitude of applied vibrations was measured with a laser-Doppler vibrometer and images of moving droplets were captured with a high-speed camera. Measurements of droplet edge displacement were performed in MATLAB using custom scripts. All numeric data is presented as mean±standard deviation.

Results and Discussion

In order to best account for the energy input of the vibrations, ARC devices were characterized by the minimum acceleration amplitude at which the substrate must be vibrated in order for transport to occur (ARC threshold). This threshold is known to be dependent on volume and material properties of the droplet (e.g. surface tension) and the interaction of the droplet footprint with the ARC surface pattern.

Effects of Duty Cycle

The ARC threshold of the SiO2-FOTS tracks was first determined over a range from 60 to 100 Hz (FIG. 3). We observed that the ARC threshold profiles, although not identical, were relatively similar on tracks with both 8.3% and 16.6% duty cycles. Additionally, the transition from 8.3% to 16.6% duty cycle also demonstrated an overlapping ARC threshold profile. However, the ARC threshold for the transition from 16.6% to 8.3% duty cycle exhibited a unique profile with significantly higher vibration thresholds above 60 Hz. We hypothesized that the observed increase in ARC threshold is due to the combination of increased pinning on the higher duty cycle region (trailing edge—facing the direction opposite of transport) and increased slip (de-wetting) on the lower duty cycle region (leading edge—facing the direction of transport).

Figure 4A:
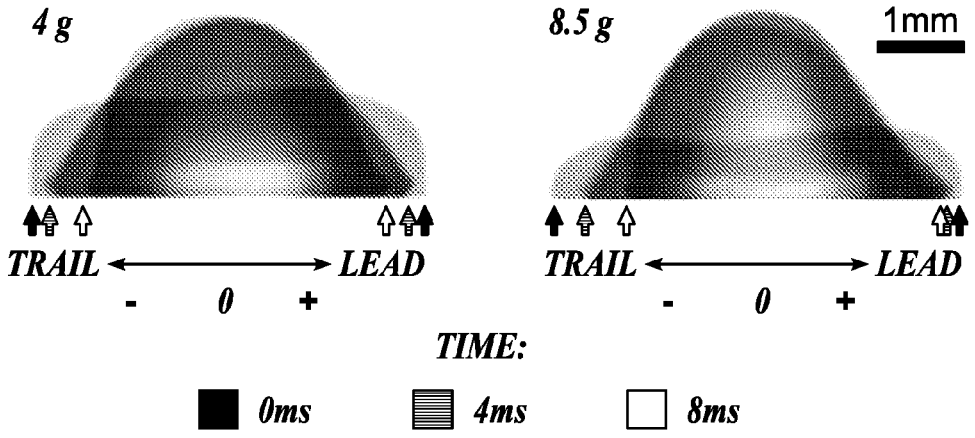
FIG. 4: Increased trailing edge mobility reduces slip at leading edge. De-wetting sequence (4A—figure overlay) demonstrates the difference in droplet response when vibrated on a 16.6% to 8.3% duty cycle transition at 4 and 8.5 g. Measurements of droplet edges (A—table) indicate slip (de-wetting) and spread (wetting) is the same for both edges at 4 g. Raising the vibration amplitude to 8.5 g increased the spread of the trailing edge, but actually reduced the spread of the leading edge. However, this resulted in a lower slip at the leading edge and higher slip at the trailing edge (compared to spread), which provided for droplet transport. Real-time positions of droplet edges (with respect to the droplet center at 0 ms) at 4 g (4B) and 8.5 g (4C) demonstrate how these observed differences in slip and spread translate to net transport at 8.5 g. Note that at the leading edge, spread is in the positive direction (direction of net transport) and slip is in the negative direction, conversely, at the trailing edge, spread is in the negative direction while slip is in the positive direction. Additionally, slip is defined as the distance from maximum to minimum wetting, while spread is the distance from minimum wetting to maximum wetting in the next half of the cycle.
Figure 4B:
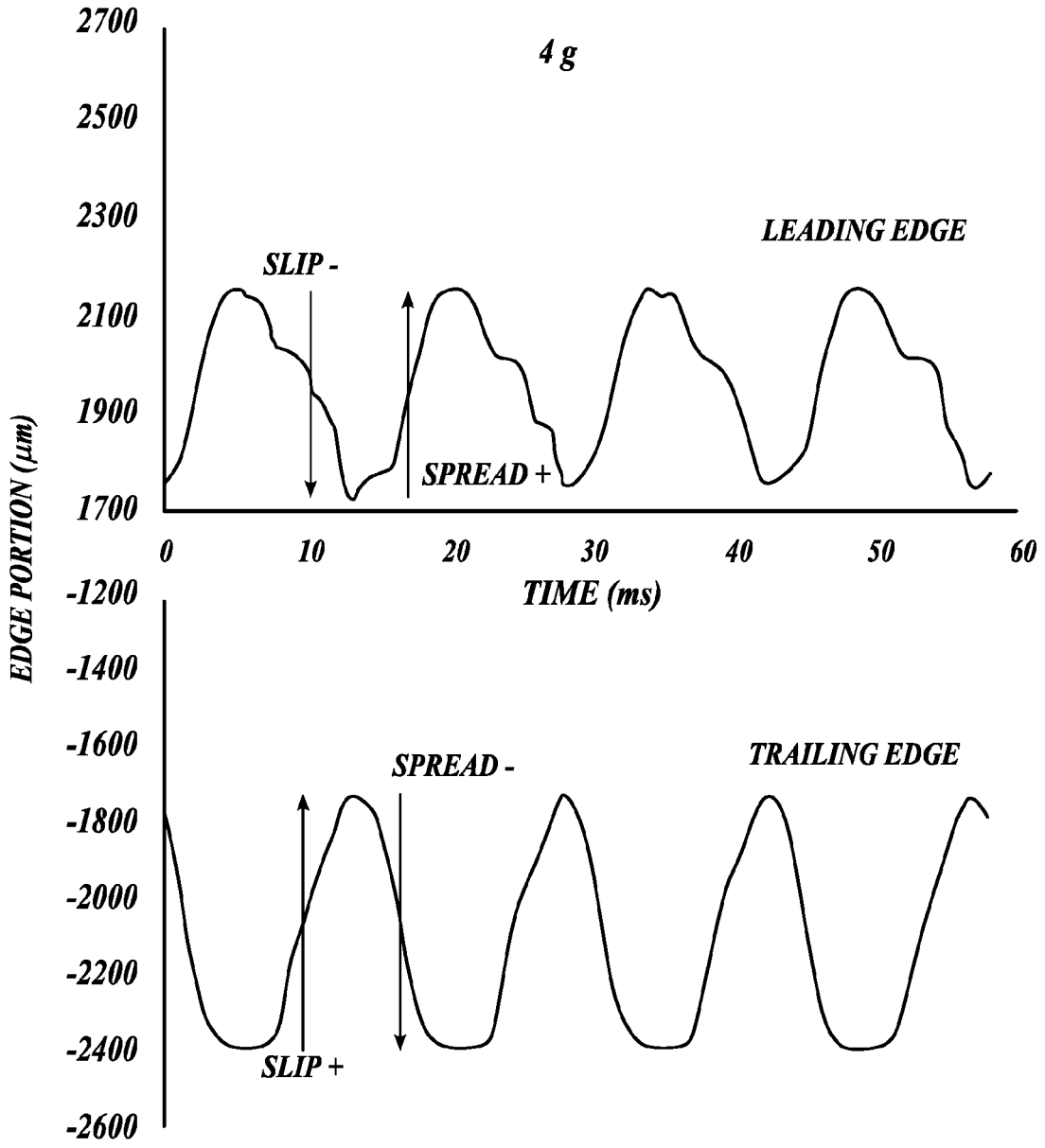
Figure 4C:
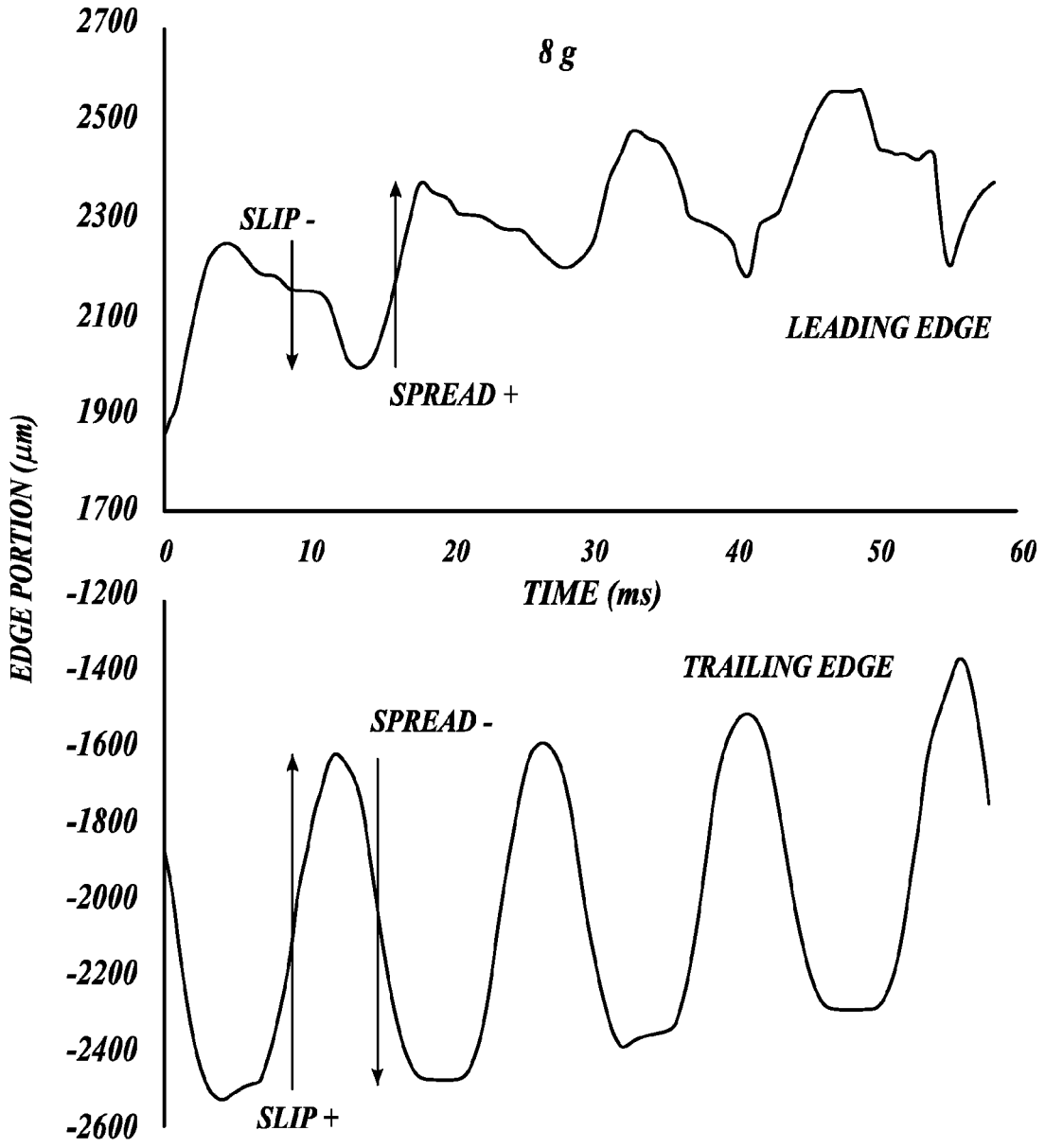
Figure 5A:
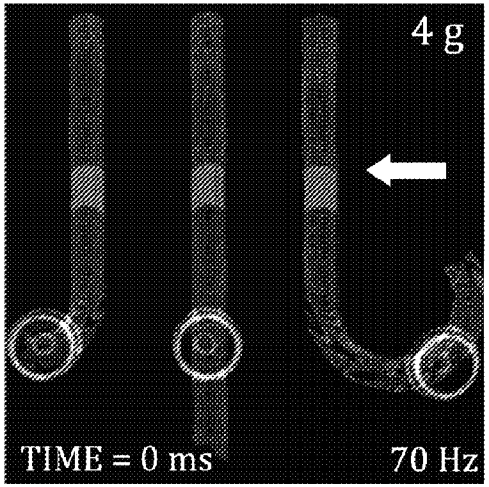
FIGS. 5A-5F: Droplet synchronization with ARC gates. Droplets transported on unique ARC paths with vibrations below the threshold of the ARC gate will pause at the transition from 16.6% to 8.3% duty cycle (indicated by the white arrow). Droplets will remain indefinitely at this position in the ARC gate, which allows droplets on all transport paths to line up (ARC patterns are superimposed in gray). Increasing the vibration signal above the gate threshold continues droplet transport in a tight distribution.
Figure 5B:
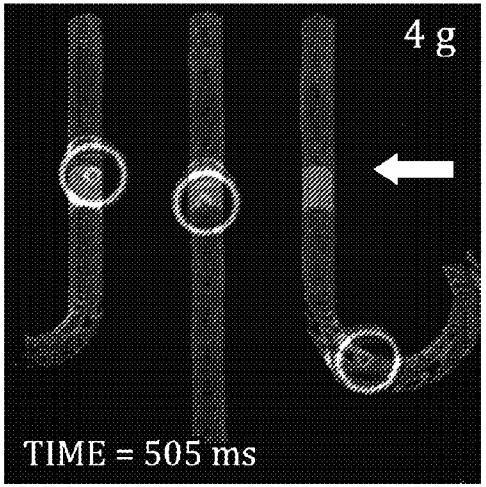
Figure 5C:
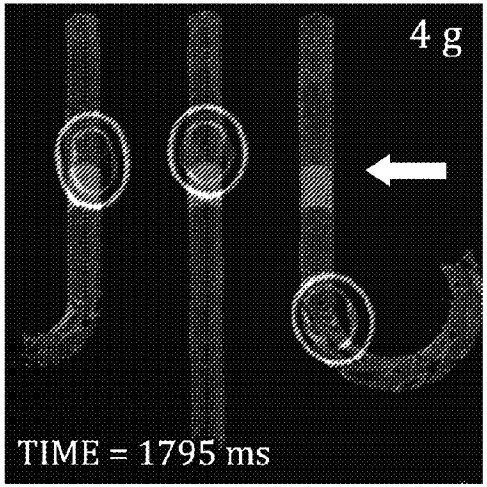
Figure 5D:
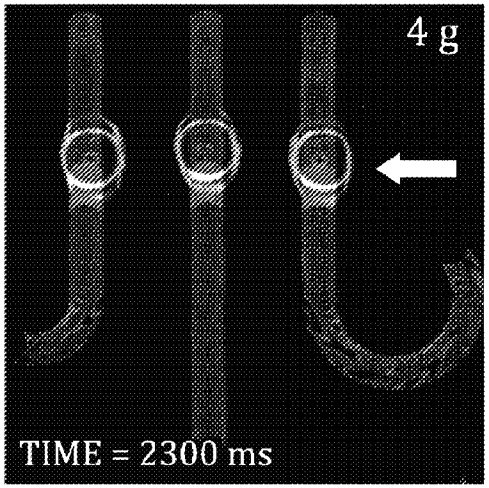
Figure 5E:
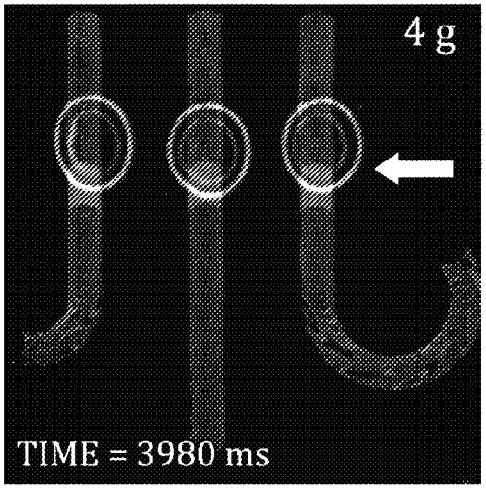
Figure 5F:
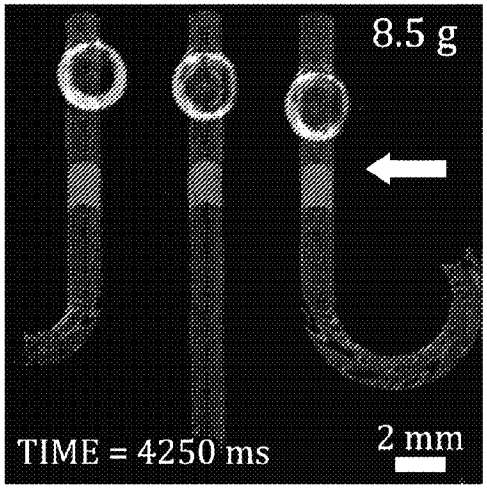

To investigate this hypothesis we recorded the motion of droplets on the 16.6% to 8.3% transition region when driven by vibrations above (8.5 g) and below (4 g) the ARC threshold for this transition at 70 Hz (FIG. 4). The slip, or the de-wetting distance from maximum to minimum wetting in the first half of the cycle, and spread, the wetting distance from minimum to maximum wetting in the second half of the cycle, of both the leading and trailing edges were measured from these records. These measurements indicated that the distance of edge spread during wetting was essentially the same as the distance of edge slip during de-wetting, for both edges, with 4 g vibrations. However, with the larger 8.5 g vibrations, the overall slip of the leading edge was less than its spread, and the slip was greater than the spread of the trailing edge. The average of these differences provides for a net transport of the droplet (FIG. 4A). It is important to note that the average transport (90.8 μm) is less than the distance between the 120 μm spaced rungs on the leading edge but greater than the 60 μm period of the ARCs on the trailing edge. The large standard deviation (41.7 μm) also indicates the droplet does not take the same size step each cycle. For example, the leading edge may advance by one large step (rung) some cycles and zero steps in others, while the trailing edge has a higher probability of advancing by a smaller step each cycle (this effect can be seen in the edge tracking curves—FIG. 4C). However, these step sizes and probabilities ultimately average out and provide for net transport over many vibration cycles.

We also observed that the total motion of the trailing edge was greater than the leading edge under both vibration conditions. Due to the curvature of the droplet and asymmetry of the ARC design, the pinning on the trailing edge is less than the leading edge during both wetting and de-wetting cycles. Therefore, this anisotropy accounts for the difference in displacement distances between edges. Unexpectedly, the spread (wetting) of the leading edge is actually reduced when the vibration amplitude is increased to 8.5 g. This observance initially seemed paradoxical, as net transport occurs at 8.5 g but not at 4 g. However, the maximum droplet footprint is larger at 8.5 g, as the total displacement of the trailing edge is increased to a larger extent by the higher amplitude vibrations. The increase of the droplet footprint size in response to a larger vibration amplitude is also consistent with established theory in vibrated sessile droplets. This observation likely results from the difference in pinning forces acting on the leading and trailing edges, as the increased energy in the larger vibrations is more easily dissipated through movement of the trailing edge (less pinning). This asymmetry indicates that the leading and trailing edges are mechanically linked by the droplet (e.g. surface tension). Taking this concept a step further, the subsequent reduction in the slip of the leading edge suggests that the increased mobility of the trailing edge results in a reduction of pinning forces acting against the trailing edge during de-wetting. This change in forces would then be translated to the leading edge, reducing slip as observed in the data.

ARC Gates

The effects of duty cycle transitions were then employed to enable "ARC gates", which can selectively pause droplet transport based on the signal of the applied vibrations. Droplet gates were developed by nesting a region with a higher (16.6%) duty cycle within a track composed of a lower (8.3%) duty cycle. Droplets driven by vibrations below the ARC threshold for the gate will pass through the transition from low to high duty cycle, but will pause on the transition from 16.6% to 8.3% duty cycle. When the vibration signal is increased above the ARC threshold for the gate, droplet transport will resume. Additionally, if a droplet is driven with a vibration above the ARC threshold for the gate before entering the gate, then it will pass through without stopping.

Stopping droplets on an ARC chip was previously achievable by turning off the vibration signal. However, this would stop all droplets being transported on a chip. ARC gates provide the ability to pause a single droplet without affecting the transport of other droplets on chip. For example, FIG. 5 demonstrates how droplets with unique transport paths can be synchronized with ARC gates. On this chip, three droplets, each on a unique ARC path, are transported by vibrations below the ARC threshold for the gate. The transport of each droplet will be paused once it reaches the gate. This allows for droplets on longer paths, such as the droplet on the left, or droplets that are performing processes elsewhere on chip to continue their transport. Once all three droplets have lined up on the gates, the vibration amplitude is increased, resuming the transport of all droplets in a tight distribution. In addition to synchronization, these devices can also be applied on an ARC system to hold droplets over a detection region or sensor, controllably mix droplets in the same transport path, and control the timing or sequencing of a droplet on chip.

ARC Switches

A transition in duty cycle changes the balance of pinning forces along one dimension of the droplet (between the leading and trailing edges). To understand how this balance of forces responds to changes in two dimensions, we added a second perpendicular track next to a main track. In this case pinning forces are acting on the leading and trailing edges of the droplet like a normal ARC device, but when the droplet reaches the perpendicular track, pinning forces will also act on one 'side' of the droplet. We found that this simple combination provides an intersection, or 'switch', that can dictate the direction of droplet transport based on the applied vibration signal. Previously, switches on ARC devices had been realized through pairing with electro wetting, but the devices presented here are the first to provide the capability of controlling droplet directionality with no active surface components. The threshold profile for ARC switches was determined as previously discussed. However, data presented here describes two thresholds—1) the vibration required for a droplet to be transported through the intersection on the main track (straight) and 2) the vibration required for the droplet to turn onto the perpendicular track (turn—FIG. 6). Data is presented for switches having a main track and perpendicular track of 8.3% duty cycle and a main track of 8.3% with a perpendicular track of 16.6% duty cycle.

The directional thresholds indicate that the increased pinning of the 16.6% perpendicular track induced droplets to turn at the intersection with considerably lower amplitudes than switches with an 8.3% perpendicular track. Interestingly, droplets transported on switches with the 16.6% perpendicular track only turned when vibrations of 60 and 70 Hz were applied. On these switches, turning was also possible with 50 and 80 Hz vibrations, but, for all frequencies other than 60 or 70 Hz, droplets on switches with an 8.3% perpendicular track would rupture or bounce off the substrate before turning. It should also be noted that vibration parameters exist where droplets can both go straight or turn with some probability. Therefore, it is more accurate to describe these parameters as "having a high probability" of driving the droplet straight through or turning at the interesting.

Figure 10A:
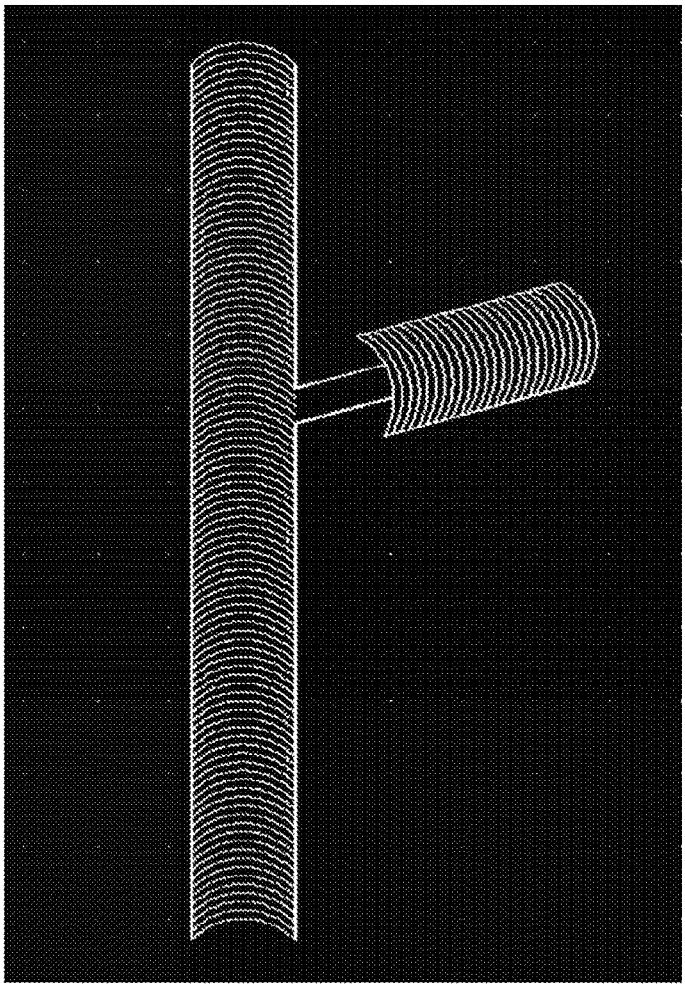
FIG. 10A illustrates an exemplary switch at a non-normal angle formed between the main track and the switch track.
Figure 10B:
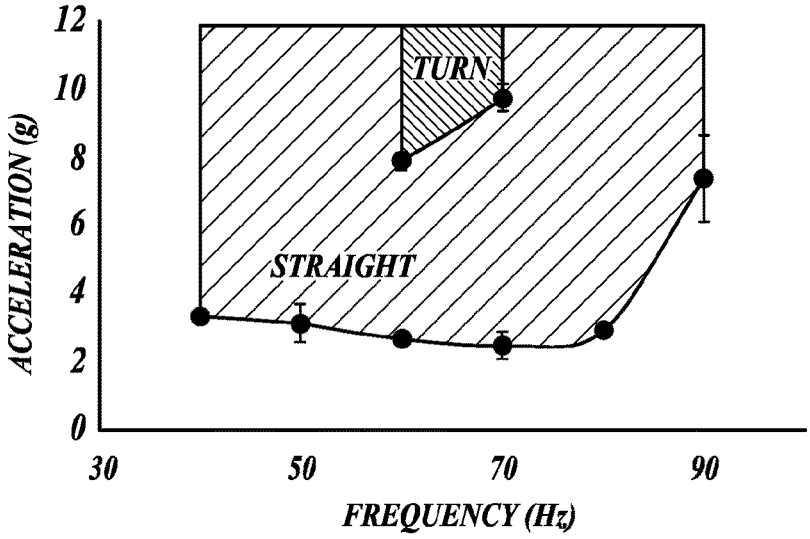
FIG. 10B graphically illustrates operation of the exemplary device of FIG. 10A.

FIG. 10A illustrates an exemplary switch at a non-normal angle formed between the main track and the switch track. FIG. 10B graphically illustrates operation of the exemplary device. Wherein, both the main and switch track have a duty cycle of 8.3%. Adjusting the angle of the switch track to 15° from normal showed no significant differences in performance compared to 8.3% duty cycle switches with the switch track normal to the main track.

In order to better understand the observed threshold profiles, videos were captured for each possible result on switches with a 16.6% duty cycle perpendicular track. The maximum width and length of the droplet were measured, where width is the size of the droplet footprint perpendicular to the axis of the transport and length is the size of the droplet footprint parallel to the axis of transport (along the ARC track). Predictably, turning only occurred when the width of the droplet was large enough to reach the perpendicular track (separated from the center of the main track by a distance of 1750 μm—FIG. 7). However, the droplet width was large enough to reach the perpendicular tracks when the droplet went straight at 50 Hz. This observation indicates that another condition must be satisfied in order for droplet transport to occur. We also observed that raising the vibration amplitude increased the width of the droplet more than the length. The width-to-length aspect ratio (FIG. 7) demonstrates this trend, as this ratio is increased with increasing vibration amplitude. Although the spread and slip of each edge was not analyzed here, the observed changes in aspect ratio with increasing vibration amplitude are similar to the results of increasing vibration amplitude on the ARC gate, discussed previously. Meaning that the energy of increased vibration amplitude is distributed through the droplet were pinning is lowest (least resistance on the edges next to the ARC track). Through these measurements, we see that a minimum aspect ratio appears to be present for turning to occur, as droplets transported with 50 Hz vibrations require an aspect ratio of 0.95 to turn.

Figure 8A:
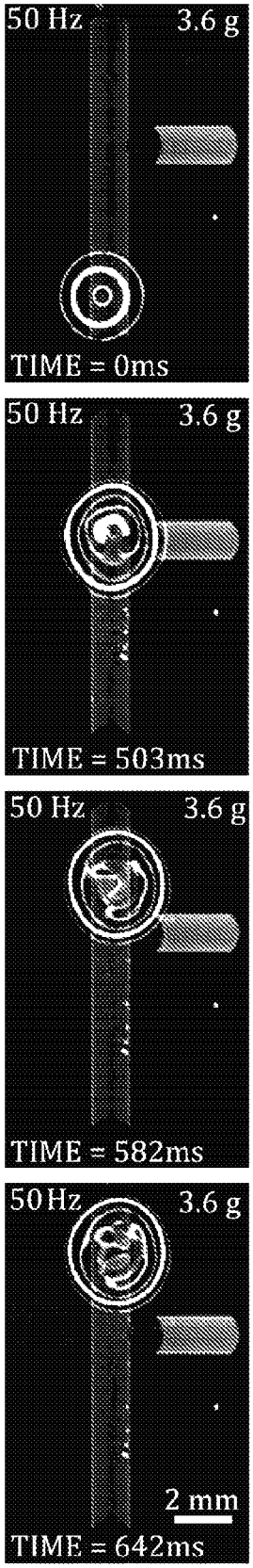
FIG. 8: ARC switches can select direction of droplet transport. Image sequence shows droplets transported on an ARC switch having a main track of an 8.3% duty cycle with a perpendicular track of a 16.6% duty cycle. Droplets transported at 50 Hz and 3.6 g (8A) do not contact the perpendicular track and move straight through the intersection. Raising the amplitude to 7.6 g (8B) increases wetting and causes the droplet to turn at the intersection. Vibrations of 60 Hz and 3.9 g (8C) also provide sufficient wetting to turn the droplets at the intersection. Note that the maximum droplet footprint is larger at 50 Hz and 7.6 g, but the width-to-length aspect ratio is larger with vibrations at 60 Hz and 3.9 g.
Figure 8B:
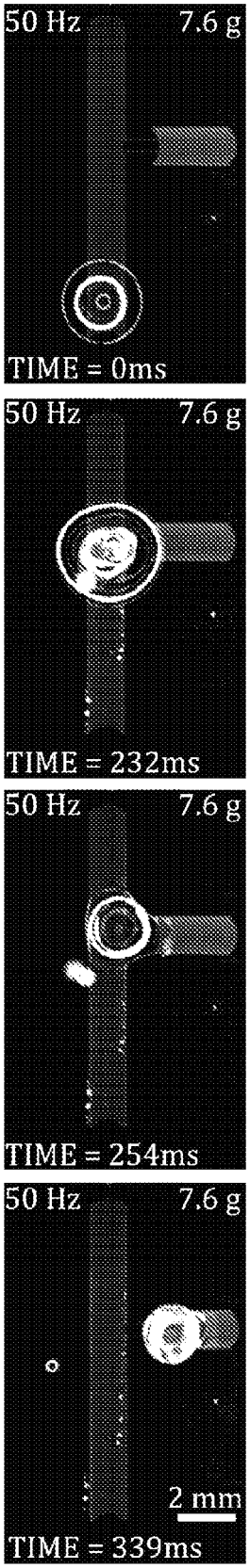
Figure 8C:
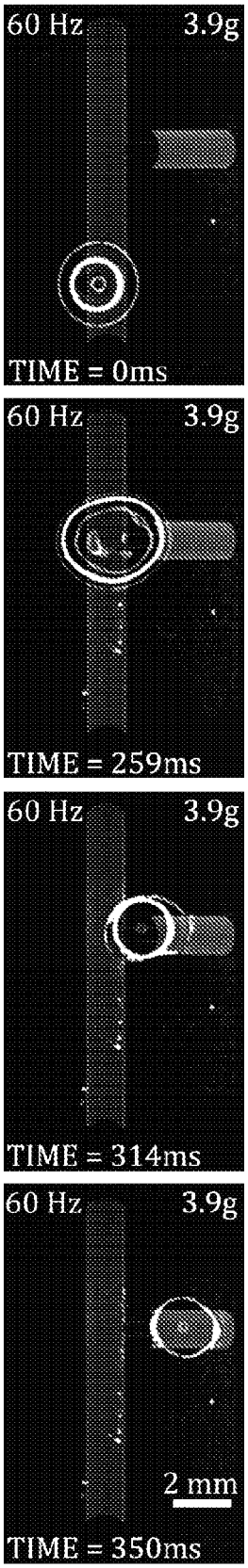

The effect of aspect ratio on the directional decision of the droplet at the switch intersection is demonstrated in FIG. 8A-8C. Wherein, droplets transported at 50 Hz have a low aspect ratio with smaller (3.6 g) vibration amplitudes and pass through the intersection, even though the width is enough to catch the perpendicular track. Raising the vibration amplitude (to 7.6 g) slightly increases the size of the droplet footprint, but also increases the aspect ratio of the droplet and causes the droplet to turn onto the perpendicular track. However, at 60 Hz, the aspect ratio is higher with smaller (3.9 g) vibrations, and the width of the droplet is sufficient to pull the droplet onto the perpendicular track, turning at the intersection. The decision between turning and continuing straight likely results from a competition of forces between the leading edge and right edge (contacting the perpendicular track) of the droplet. Exemplified by the droplets transported at 50 Hz, the right edge of droplets with a lower aspect ratio would experience a lower net force from pinning on the perpendicular track. Conversely, the leading edge of droplets with a higher aspect ratio would experience a lower net force from pinning on the straight track. Therefore, the direction of transport is decided based on this balance of forces.

This balance of forces is dependent on the ARC design (e.g. duty cycle and spacing) and the parameters of the applied vibrations.

ARC Junctions and Systems

A junction is illustrated in FIG. 9A and is composed of a main track and secondary track that is normal to and directed towards the main track. Both tracks have the same duty cycle (8.3% in the presented embodiment). There is also a small wicking region between the two tracks that acts to connect the tracks without compromising droplet transport. The two primary functions of the junction are to 1) DELIVER the droplet from the secondary track to the main track and 2) move a droplet along the main track and PASS the wicking region without stopping. FIG. 9B characterizes a representative junction over a range of frequencies and accelerations for both functions. These plots show the junction can perform both functions at reasonable frequency and amplitude combinations and provide selective control between the functions through vibration parameters. In other words, this device can be controlled to hold droplets on the secondary track at the wicking region while droplets on the main track move past or deliver droplets from the secondary track to the main track while passing droplets on the main track, merging the two droplets at this location. This functionality essential for enabling complex processes on ARC systems, for example junctions also allows droplets from multiple sources (i.e. samples) to be moved on to the same track without impeding the transport of other droplets downstream of the junction.

As illustrated in FIG. 11, the ARC devices and elements disclosed herein are readily combined to form complex systems incorporating several device elements disclosed herein. In the exemplary system of FIG. 11, the device includes two inlets (INLET 1 and INLET 2), which feed droplets into individual rings (RING 1 and RING 2) via JUNCTION 1 and JUNCTION 2. SWITCH 1 feeds droplets from RING 1 into LOOP 1, which includes junctions, switches, a portion of RING 2, and a "merging region" that includes GATE 1. Using LOOP 1 a combined droplet can be formed by combining a droplet from INLET 1 and a droplet from INLET 2 by merging them at GATE 1. The combined droplet can then be passed out of this portion of the device via the OUTLET.

CONCLUSION

ARCs are a recently developed microfluidic platform that transports liquid droplets through a passive surface pattern and orthogonal vibrations. The facile fabrication and operation of ARC devices shows much potential to meet applications in low-cost diagnostic and analytic applications. In this work, we demonstrate new expansions to the ARC functional toolbox with the development of ARC gates, ARC junctions, and ARC switches. These devices derive their utility by changing the balance of pinning forces between edges of a transported droplet, either in one or two dimensions. ARC gates can controllably pause droplet transport through an increase in pinning forces at the trailing edge of a droplet, while ARC switches provide control over droplet direction at an intersection by applying pinning forces at a side edge of the droplet. ARC junctions transfer a droplet from one track to a second track. Overall, the addition of these capabilities opens many new possibilities for the application of ARC devices. Furthermore, these devices provide ARCs the ability to control the timing and synchronization droplets, a requirement for massively parallel operations and high-throughput processing.

While illustrative embodiments have been illustrated and described, it will be appreciated that various changes can be made therein without departing from the spirit and scope of the invention.

The embodiment of the invention which as exclusive property of privilege is claimed are defined as follows:

1. A device configured to move a droplet on a surface between a first track and a second track, the device comprising a surface comprising:

a first track comprising a plurality of transverse arcuate regions having a different degree of hydrophobicity than a surrounding region;

a second track comprising a plurality of transverse arcuate regions having a different degree of hydrophobicity than the surrounding region, wherein the transverse arcuate regions of the first track and the second track are sized and spaced to induce asymmetric contact angle hysteresis when the droplet is vibrated; and an intersection between the first track and the second track, wherein the intersection is configured to selectively transition the droplet between the first track and the second track under specific vibration characteristics.

2. The device of claim 1, wherein the intersection is a junction configured to selectively transition a droplet from the second track to the first track, wherein the second track is configured to direct the droplet towards the junction.

3. The device of claim 1, wherein the intersection is a switch configured to selectively transition a droplet from the first track to the second track, wherein the second track is configured to direct the droplet away from the junction.

4. The device of claim 1, wherein the first track includes a first portion having a first duty cycle and the second track includes a second portion having a second duty cycle that is different the first duty cycle.

5. The device of claim 4, wherein the first portion and the second portion are adjacent to the intersection, such that during operation the droplet is transferred between the first portion and the second portion.

6. The device of claim 1, further comprising a source of vibratory motion configured to controllably vibrate the droplet.

7. The device of claim 1, wherein the plurality of transverse arcuate regions and the surrounding region are optically flat.

8. The device of claim 1, wherein the plurality of transverse arcuate regions and the surrounding region are coplanar.

9. The device of claim 1, wherein the transverse arcuate regions define substantially circular arcs having a constant radius.

10. The device of claim 9, wherein the constant radius is approximately equal to a radius of a footprint of the droplet.

11. The device of claim 9, wherein the substantially circular arcs are equal to or less than ½ of a circle.

12. The device of claim 1, wherein the plurality of transverse arcuate regions and the surrounding region are transparent at visible wavelengths.

13. The device of claim 1, wherein the droplet has a degree of hydrophobicity closer to the degree of hydrophobicity of the transverse arcuate regions than that of the surrounding region.

14. The device of claim 1, wherein the surrounding region is a hydrophobic material and the transverse arcuate regions are defined in the surrounding region by removing the hydrophobic material to expose a hydrophilic material underneath.

15. The device of claim 1, wherein the device includes at least two device elements selected from the group consisting of a loop, a gate, a junction, and a switch, such that the at least two device elements are configured to manipulate the same droplet when operated.

16. A method of moving a droplet on a track on a surface of a device according to claim 1, the method comprising:

depositing the droplet on the track such that a front portion of the droplet contacts a first of the plurality of arcuate regions of the track; and vibrating the droplet at a frequency and amplitude sufficient to cause the droplet to deform such that the front portion of the droplet contacts a second of the plurality of arcuate regions of the track, thereby urging the droplet towards the second of the plurality of arcuate regions.

17. The method of claim 16, the step of vibrating the droplet comprises a technique selected from the group consisting of acoustic vibration, electromagnetic vibration, and piezoelectric vibration.

18. The method of claim 16, the step of vibrating the droplet comprises vibrating the surface.

19. The method of claim 16, wherein the device is a switch and the step of vibrating the droplet comprises vibrating the droplet at a vibration signal sufficient to move the droplet from the first track to the second track, thereby moving the droplet away from the switch on the second track.

20. The method of claim 16, wherein the device is a junction and the step of vibrating the droplet comprises vibrating the droplet at a vibration signal sufficient to move the droplet from the second track to the first track, thereby moving the droplet towards the junction on the second track, through the junction, and then away from the junction on the first track.

* * * * *